US011434722B2

(12) United States Patent
Green et al.

(10) Patent No.: US 11,434,722 B2
(45) Date of Patent: Sep. 6, 2022

(54) DOWNHOLE FLOW CONTROL DEVICE AND METHOD

(71) Applicant: Tendeka AS, Stavanger (NO)

(72) Inventors: Annabel Green, Aberdeenshire (GB); Colin Mackie, Aberdeen (GB); Allan Gill, Aberdeen (GB)

(73) Assignee: TENDEKA AS, Stavanger (NO)

( * ) Notice: Subject to any disclaimer, the term of this patent is extended or adjusted under 35 U.S.C. 154(b) by 4 days.

(21) Appl. No.: 15/037,816

(22) PCT Filed: Jan. 21, 2015

(86) PCT No.: PCT/EP2015/051166
§ 371 (c)(1),
(2) Date: May 19, 2016

(87) PCT Pub. No.: WO2015/110486
PCT Pub. Date: Jul. 30, 2015

(65) Prior Publication Data

US 2016/0312579 A1 Oct. 27, 2016

(30) Foreign Application Priority Data

Jan. 21, 2014 (GB) ..... 1400999

(51) Int. Cl.

| | |
|---|---|
| ***E21B 34/10*** | (2006.01) |
| ***E21B 43/12*** | (2006.01) |
| ***E21B 34/14*** | (2006.01) |
| ***E21B 34/06*** | (2006.01) |
| ***E21B 47/06*** | (2012.01) |

(52) U.S. Cl.
CPC ..... *E21B 34/10* (2013.01); *E21B 34/066* (2013.01); *E21B 34/14* (2013.01); *E21B 43/12* (2013.01); *E21B 47/06* (2013.01); *E21B 2200/06* (2020.05)

(58) Field of Classification Search
CPC ..... E21B 34/10; E21B 34/14; E21B 34/066; E21B 34/12; E21B 47/06; E21B 47/14
See application file for complete search history.

(56) References Cited

U.S. PATENT DOCUMENTS 4,077,425 A * 3/1978 Drori ..... F16K 31/363 137/219
5,299,640 A 4/1994 Streich et al.
(Continued)

FOREIGN PATENT DOCUMENTS

CN 202338279 U 7/2012
WO WO-0165063 A1 9/2001
(Continued)

OTHER PUBLICATIONS

International Search Report PCT/ISA/210 for International Application No. PCT/EP2015/051166 dated May 26, 2015.
(Continued)

*Primary Examiner* — D. Andrews
(74) *Attorney, Agent, or Firm* — Harness, Dickey & Pierce, P.L.C.

(57) ABSTRACT

A downhole flow control device and associated method, wherein the downhole flow device is configured for use with a tubing string, the downhole flow device including a flow path configured to permit flow between external and internal locations of a tubing string; a barrier member configured to selectively vary the flow path; and a receiver configured to receive a control signal to permit control of the barrier member. Beneficially, the downhole flow device may be at least partially operable by fluid or fluid pressure from the tubing string or wellbore. Corresponding fracking valve assemblies, completion assemblies, inflow control device and hydraulic distribution modules may be provided.

26 Claims, 11 Drawing Sheets

(56) References Cited

U.S. PATENT DOCUMENTS

| | | | | |
|---|---|---|---|---|
| 5,531,270 | A * | 7/1996 | Fletcher | E21B 34/06 166/319 |
| 6,454,025 | B1 * | 9/2002 | Runquist | E21B 4/14 175/61 |
| 2007/0204995 | A1 | 9/2007 | Hofman et al. | |
| 2009/0206290 | A1 | 8/2009 | Wygnanski | |
| 2013/0048291 | A1 | 2/2013 | Merron et al. | |
| 2013/0133878 | A1 * | 5/2013 | Urban | E21B 21/103 166/194 |
| 2013/0248178 | A1 * | 9/2013 | Hecker | E21B 33/12 166/278 |
| 2013/0319767 | A1 | 12/2013 | Wilson et al. | |

FOREIGN PATENT DOCUMENTS

| | | | |
|---|---|---|---|
| WO | WO-2012100259 | A2 | 7/2012 |
| WO | WO-2013151657 | A1 | 10/2013 |

OTHER PUBLICATIONS

Written Opinion of the International Searching Authority PCT/ISA/237 for International Application No. PCT/EP2015/051166 dated May 26, 2015.

Search Report for corresponding Great Britain Application No. GB1400999.7 dated Aug. 4, 2014.

* cited by examiner

DOWNHOLE FLOW CONTROL DEVICE AND METHOD

CROSS-REFERENCE TO RELATED APPLICATIONS

This application is a national phase under 35 U.S.C. § 371 of PCT International Application No. PCT/EP2015/051166 which has an International filing date of Jan. 21, 2015, which claims priority to United Kingdom Patent Application No. 1400999.7, filed Jan. 21, 2014, the entire contents of each of which are hereby incorporated by reference.

FIELD OF THE INVENTION

The present invention relates to a downhole flow control device and corresponding method, and in particular to a downhole flow control device and method for selectively permitting flow between internal and external regions of a tubing string.

BACKGROUND TO THE INVENTION

In the oil and gas industry, various wellbore operations require fluids to be communicated between the surface and a downhole location, and strings of tubing are typically installed or used within a drilled wellbore for this purpose. For example, tubing strings may permit injection of a desired fluid or material into a subterranean formation, delivery of a drilling fluid to the wellbore during drilling, production of formation fluids to surface, delivery of a control fluid to actuate a downhole tool, or the like.

In operations which require communication between external and internal locations of the tubing string, for example to permit communication with a formation, a suitable flow path must be established. This flow path may be provided by ports within the wall of the tubing string, a valve assembly or the like positioned at the desired location of communication. However, many operations may require selective communication between external and internal locations and as such will require the capability of selective control of the flow path. For example, poor production rates from a formation may be a consequence of reduced formation permeability, which may be caused by clogging from drill cuttings, mud cake, formation particulate matter, matrix collapse or the like. This may be addressed by performing a hydraulic fracturing operation which involves injecting a fluid at a pressure sufficient to fracture or crack the geological structure of the formation to therefore increase or restore permeability and production rates. Accordingly, it is desirable to install suitable flow devices, such as frac valves, within a completion string which can be controlled, when required, to permit selective injection of a fracking fluid into the formation.

It is currently known in the art to control flow devices, such as frac valves and the like, by use of balls or darts which are dropped from surface to land on a seat within a tubing string. This permits fluid pressure to be established behind the ball or dart to effect displacement of one or more components associated with a flow device, thus providing the necessary control, for example opening a valve. However, the presence of the ball or dart generates a restriction within the tubing string which may be undesirable, particularly where access is required below the ball or dart, for example to other flow control devices. Furthermore, if the flow device needs to be reset, for example to close a valve, then a workover or intervention operation must be performed to reset the device and remove the ball or dart.

Furthermore, in most cases wellbores are formed which have an extended generally horizontal section, and in such cases balls or darts will require to be pumped towards the desired location, which provides added complexity by necessitating complex pumping operations, equipment and the like.

SUMMARY OF THE INVENTION

According to a first aspect of the present invention there is provided a downhole flow control device configured for use with a tubing string, the device comprising:

- a flow path configured to permit flow between external and internal locations of a tubing string; and
- a barrier member configured to selectively vary the flow path.

Advantageously, the flow control device may comprise a receiver configured to receive a control signal to permit control of the barrier member.

In use, the control signal may be transmitted to the flow control device which may be received by the receiver. The flow control device may be configured to control and/or operate the barrier member responsive to the control signal. This may accordingly permit control of the barrier member, for example to vary the flow path. Varying the flow path may comprise at least partially and optionally fully opening and/or closing the flow path.

The flow control device may be adapted to be located within a wellbore. In use, the flow control device may define an annular region between an outer surface thereof and an inner surface of the wellbore. The flow path may permit communication between the annulus and an internal location of a tubing string, for example in one or both directions.

The barrier member may be movable or slidable, e.g. to selectively vary the flow path. The barrier member may be movable or slidable along the tubing string. The flow control device may be configured to control and/or operate the barrier member by moving the barrier member.

The flow control device may comprise an actuator configured to move or displace the barrier member to vary the flow path. The flow control device may comprise an electrical actuator, fluid actuator, mechanical actuator or the like, or any suitable combination thereof.

Advantageously, the flow control device may be at least partially operable by fluid or fluid pressure from the tubing string or wellbore. Walls of the tubing string and/or the flow control device and/or the wellbore may comprise or at least partially define at least one communication channel for communicating fluid or fluid pressure between the tubing string or wellbore (e.g. from within the tubing string or wellbore) and the flow control device. The fluid or fluid pressure from the tubing string or wellbore that may at least partially operate the flow control device may comprise fluid or fluid pressure communicated to the flow control device via the communication channel(s).

The barrier member may be selectively movable or slidable by, and/or the actuator may be operable using, the fluid or fluid pressure from within the tubing string or wellbore, e.g. a pressure differential between the fluid pressure within the tubing string or wellbore and a fluid at a higher or lower pressure. The fluid or fluid pressure may comprise a fracking or hydraulic fluid or fluid pressure. The pressure differential may comprise a difference between a fracking fluid pressure and a hydraulic, wellbore or atmospheric pressure. The flow control device may be configured to selectively apply fluid, e.g. pressurised fluid, from the tubing string or wellbore to one or either of opposing sides of the barrier member, e.g. to set up a pressure differential between the opposing sides of the barrier member, which may selectively move or displace the barrier member, e.g. to vary, open and/or close the flow path.

The actuator may comprise a force applying device, such as a spring, a resiliently compressible member, an elastomeric member, a hydraulic chamber or ram and/or the like. The barrier member may be movable or slidable responsive to the force applying device.

The force applying device may be settable and/or resettable by or using the fluid or fluid pressure from within the tubing string or wellbore, e.g. a pressure differential between the fluid pressure from the tubing string or wellbore and a fluid at a higher or lower pressure. The fluid or fluid pressure may comprise a fracking or hydraulic fluid or fluid pressure. The fluid pressure differential may comprise a difference between a fracking fluid pressure and a hydraulic, wellbore or atmospheric pressure. Resetting or setting the force applying device may comprise compressing and/or pressurising the force applying device.

The actuator may comprise a counter member, such as a plunger or piston. The counter member may be movable or displaceable responsive to the fluid or fluid pressure from the tubing string or wellbore, e.g. a pressure differential between the fluid pressure within the tubing string or wellbore and a fluid at a higher or lower pressure. The fluid or fluid pressure may comprise a fracking or hydraulic fluid or fluid pressure. The fluid pressure differential may comprise a difference between a tracking fluid pressure and a hydraulic, wellbore or atmospheric pressure.

One or both of the counter member and/or the barrier member may be movable or displaceable relative to each other, e.g. under the action of the force applying device and/or the fluid or fluid pressure from the tubing string or wellbore. The counter member may be movable or displaceable, e.g. relative to the barrier member, in order to set or reset the force applying device. The barrier member may be movable or displaceable, e.g. relative to the counter member, in order to vary the flow path.

The force applying device, barrier member and/or counter member may be movable or operable responsive to swelling or expansion of a swellable or expandable member, such as a member that is swellable or expandable in fluid, such as fluid found in the wellbore, for example, drilling or production fluid, e.g. water and/or oil.

The force applying device, barrier member and/or counter member may be movable or operable responsive to pressure produced by a selectively activatable chemical reaction, burning of a material or the like. The force applying device, barrier member and/or counter member may be movable or operable responsive to pressure produced by a selectively activatable effervescing material.

The flow control device may be configured such that the barrier member and/or counter member (e.g. piston) is/are unidirectionally movable in order to open and/or close the flow path and/or set or reset the force applying device.

The flow control device may be operable according to a pressure drop or reduction.

The counter member (e.g. the piston) and/or the barrier member and/or the force applying device (e.g. spring) may be switchable between a configuration in which they and locked or fixed in position and a configuration where they are movable or released. The counter member (e.g. the piston) and/or the barrier member and/or the force applying device (e.g. spring) may selectively grip, release, and/or be fixable or lockable and/or releasable, e.g. to/from or between the tubing string and/or a casing or outer tubular.

The flow control device may be configured to selectively vary the flow path by selectively releasing the barrier member. The flow control device may be configured such that the barrier member is movable or displaceable responsive to the force applying device (e.g. spring) when released, e.g. to vary the flow path. For example, when the barrier member is released, the barrier member may be movable or displaceable relative to (e.g. away from) the counter member under the action of the force applying member, e.g. to vary the flow path, preferably whilst the counter member is fixed.

The flow control device may be configured such that when the counter member is released, the counter member may be movable or displaceable, e.g. under the action of the fluid pressure, in order to set or reset the force applying device. The flow control device may be configured such that when the counter member is released, the counter member may be movable or displaceable relative to (e.g. towards) the barrier member under the action of the fluid pressure, e.g. to set or reset the force applying device, preferably whilst the barrier member is fixed in location.

The flow control device may be operable by alternately fixing or locking the barrier member in order to reset the force applying device and releasing the barrier member in order to one and/or close the flow control device. The flow control device may be operable by alternately fixing or locking the counter member, e.g. whilst the barrier member is released or movable, in order to open and/or close the flow control device and releasing the counter member, e.g. whilst the barrier member is fixed or locked, in order to reset the force applying device.

The flow path may be at least partially defined by one or more ports, orifices, nozzles, channels, conduits or the like.

The barrier member may be configured to vary the size, e.g. cross section, of the flow path, flow resistance of the flow path or the like. The barrier member may be configurable between a closed position, in which the flow path is closed, and an open position in which the flow path is open. The barrier member may be configurable to be positioned between closed and open positions. This may permit control over the flow rate through the flow path.

The tubing string may be provided within an outer tubular or casing. The tubing string and/or outer tubular or casing may comprise one or more and preferably a plurality of ports, orifices, nozzles, channels, conduits, apertures or the like. At least one of the ports, orifices, nozzles, channels, conduits, apertures of the tubing string and/or outer tubular or casing may differ, e.g. have a different size or cross sectional area or be configured to provide a different flow rate or pressure, to at least one other port, orifice, nozzle, channel, conduit, aperture of the tubing string and/or outer tubular or casing. At least one of the ports, orifices, nozzles, channels, conduits, apertures of the tubing string and/or casing may be or comprise an outflow or injection port, such as a frac port, e.g. for conveying fluid during fracking or other injection operations. At least one of the ports, orifices, nozzles, channels, conduits, apertures of the tubing string and/or casing may be or comprise an inflow port, such as a production port, e.g. for conveying fluid during production operations. The outflow ports, e.g. frac port(s), may be larger, e.g. have a larger cross sectional area, than the inflow ports, e.g. production port(s).

The barrier member may comprise a sleeve. The barrier member may comprise a valve member. The barrier member may comprise a plug, plunger or the like. At least one port, orifice, nozzle, channel, conduit, aperture or the like may be provided in the barrier member. The barrier member may be movable such that the ports, orifices, nozzles, channels, conduits, apertures or the like in the barrier member may be selectively alignable and/or partially alignable with ports, orifices, nozzles, channels, conduits, apertures in the tubing string and/or the outer tubular or casing. The barrier member may be movable so as to selectively close or block, and/or partially close or block, one or more ports, orifices, nozzles, channels, conduits, apertures in the tubing string and/or the outer tubular or casing.

As such, the flow control device may be operable to selectively provide a flow path between external and internal locations of the tubing string and/or the outer tubular or casing through selected ports, orifices, nozzles, channels, conduits, apertures in the tubing string and/or the casing and through one or more of the ports, orifices, nozzles, channels, conduits, apertures in the barrier member. For example, the flow control device may be operable to selectively provide a flow path though the frac ports in order to carry out fracking operations. The flow control device may be operable to close or block the frac ports. The flow control device may be operable to provide a flow path through the production ports for production operations.

The barrier member may be further movable to a position that provides a flow path through one or more further ports, orifices, nozzles, channels, conduits, apertures of the tubing string and/or casing and one or more ports, orifices, nozzles, channels, conduits, apertures of the barrier member, which may comprise moving the barrier member in the same direction as the barrier member was moved in order to open and close the one or more selected ports, orifices, nozzles, channels, conduits, apertures of the tubing string and/or casing. The movement of the barrier member may be under the action of the force applying device.

The selected ports, orifices, nozzles, channels, conduits, apertures in the tubing string and/or the casing may comprise outflow ports such as frac ports. The further ports, orifices, nozzles, channels, conduits, apertures in the tubing string and/or the casing may comprise inflow ports, such as productions ports.

For example, in use, the counter member (e.g. piston), the force applying device (e.g. spring) and/or the barrier member may be placeable in the selectively fixed configuration (e.g. fixed in location). The barrier member may be in a position whereby the frac ports and/or production ports are closed or blocked by the barrier member. The force applying device may be in a compressed or pressurised configuration. The counter member may be in the selectively fixed configuration.

The barrier member and/or force applying device may be selectively unlockable or releasable, such that the force applying member applies a force between the fixed counter member and the movable barrier member so as to move the barrier member relative to the selectively fixed counter member. In this way, the barrier member may be movable under the action of the force applying device so as to open the flow path through one or more selected ports, such as the frac ports.

The force applying device and/or barrier member may be selectively fixable or lockable in position. The counter member may be unlockable or releasable. In the unlocked or released configuration, the counter member may be displaceable under action of a pressure differential comprising the fluid pressure in the tubing string and/or wellbore, e.g. toward the barrier member, which may act to compress or pressurise the force applying device. In this way, the force applying device may be reset, recompressed or repressurised using pressure differential caused by fluid from the tubing string, such as fracking fluid.

After opening the flow path through the one or more selected ports (e.g. the frac ports), the barrier member may be movable to close the one or more selected ports (e.g. the frac ports). The one or more selected ports may be closed by releasing or unlocking the barrier member and/or force applying device, e.g. when the counter member may be locked or fixed and/or the force applying device may be in a pressurised or compressed state. The force applying device may be operable to apply a force between the fixed or locked counter member and the unlocked or released barrier member, thereby to move the barrier member. The barrier member may be movable to close the one or more selected ports (e.g. the frac ports) in the same direction that the barrier member was movable in order to open the one or more selected ports (e.g. the frac ports). The barrier member may be movable between a position in which at least one of the ports, orifices, nozzles, channels, conduits, apertures of the barrier member is aligned with the one or more selected ports (e.g. the frac ports) of the tubing string and/or casing, e.g. such that the flow path is formed or opened through the respective ports of the barrier member and the tubing string and/or casing, and a position in which the ports, orifices, nozzles, channels, conduits, apertures of the barrier member are out of alignment with the one or more selected ports (e.g. the frac ports) of the tubing string and/or casing, e.g. such that there is no flow path through the respective ports of the barrier member and the tubing string and/or casing.

The counter member may be movable after the closure of the flow path through the frac ports, e.g. to reset, recompress or re-pressurise the force applying device, which may comprise the counter member being moved towards the barrier member and/or in the same direction as the barrier member is movable in order to open and/or close the one or selected ports.

The flow control device may comprise a power source. The power source may comprise a battery arrangement or the like. The flow control device may be configured to receive power from an external source. For example, the flow control device may be configured to receive power from a separate downhole component or assembly. The flow control device may be configured to receive power from a surface location. The flow control device may be configured to receive power via inductance, for example from a power source deployed downhole. The flow control device may be configured to receive power from an external location to permit operation. The flow control device may be configured to receive power from an external location to charge a battery arrangement or the like.

The flow control device may be configured for use in combination with a sealing arrangement. The flow control device may be configured for use with a zonal isolation sealing arrangement. This may permit the flow control device to be arranged for communication with an isolated downhole zone. The sealing arrangement may be configured to create a seal in an annulus formed between the tubing string and a wall surface of a wellbore, which may be an open wellbore, cased wellbore or the like. The sealing arrangement may comprise a swelling sealing assembly, which may be configured to swell upon exposure to a swelling activator, such as water, oil or the like. The sealing arrangement may comprise a mechanically actuated sealing assembly. The sealing arrangement may comprise an inflatable sealing assembly. The sealing arrangement may comprise one or more packers. At least a portion of the sealing arrangement may be provided separately of the flow control device. At least a portion of the sealing arrangement may form part of the flow control device.

The sealing arrangement may be configured to accommodate one or more cables to pass therethrough, such as cables associated with the flow control device, for example cables configured to permit communication with the receiver, cables to provide power, cables for use in sensing or the like.

In this way, for example, a plurality of flow control devices may be provided in order to selectively and/or independently control flow in different zones. For example, the flow control devices may be operable to sequentially open a flow path through one or more ports, such as frac ports, which may comprise sequentially opening frac ports on flow control devices from a distal or toe end of the wellbore to a proximate or head end of the wellbore. The flow control devices may be configured such that the flow control devices of one zone are closed before the flow control devices of another zone are opened, e.g. a zone by zone operation, such as fracking, can be performed by sequentially opening and closing flow control devices for one zone before opening and closing the flow control devices for another zone.

The flow control device may be configured for use in a downhole operation.

The flow control device may be configured to permit communication from an internal location of the tubing string to an external location of the tubing string. The flow control device may be configured for use in injecting a fluid into a downhole formation. For example, the flow control device may be configured for use in injecting water into a formation.

The flow control device may be configured for use in a fracturing operation, in which the flow control device permits communication of a fracking fluid from within the tubing string to an external location to flow into a surrounding formation. In this arrangement the flow control device may be configured as a fracking valve.

The flow control device may be configured to permit communication from an external location of the tubing string to an internal location of the tubing string. The flow control device may be configured as an inflow control device (ICD). The flow control device may be configured for use in permitting formation fluids, such as hydrocarbons to flow into the tubing string and be produced to a remote location, such as to surface.

The flow control device may be configured to permit both communication from an internal location of the tubing string to an external location of the tubing string, and communication from an external location of the tubing string to an internal location of the tubing string. For example, the flow control device may be configurable as both an injection device and an inflow device.

The flow control device may be configured to control the rate of flow of fluid to and/or from an external location. For example, the flow control device may be configured to restrict the rate of flow. In embodiments where the flow control device defines an inflow control device, this arrangement may permit a degree of control of a production rate from a downhole region of a subterranean formation. In embodiments where the flow control device defines an outflow control device, such as a fracking valve, this arrangement may permit a degree of control of a fluid injection rate, fracturing rate and/or extent.

The flow control device may be configured to be secured to a tubing string, for example via a tubing string connector, such as a threaded connector, welded connector or the like. The flow control device may be configured to form an integral part of a tubing string.

The tubing string may be formed of a number of tubular members connected together in end-to-end relation to define a continuous conduit or flow path. The tubing string may comprise one or more casing tubulars, liner tubulars, production tubulars, drill pipe, collars, coiled tubing, sand screen or the like.

The flow control device may be configured for use within a tubing string which incorporates at least one other flow control device. The at least one other flow control device may be configured in accordance with the first aspect. The flow control devices may be configured to operate in combination to perform desired downhole operations, such as injection operations, production operations or the like.

One flow control device may be configured for inflow, and another flow control device may be configured for outflow.

At least one flow control device may be configured for both inflow and outflow.

The receiver may be configured to receive a control signal transmitted via a communication path.

The communication path may be at least partially defined by a dedicated communication conduit. The communication conduit may comprise a cable, such as an electrical cable, fibre optic cable or the like. In this arrangement the control signal may be configured to be contained within a communication path defined by the communication conduit. The provision of a dedicated communication conduit may be considered to permit wired transmission of the control signal.

The communication path may be at least partially defined by a downhole medium. The downhole medium may comprise a downhole fluid, such as drilling mud, production fluids, injection fluids or the like. The downhole medium may comprise a geological structure, such as a rock structure, formation structure or the like. The downhole medium may comprise downhole equipment, such as completion equipment, drilling equipment or the like. The downhole medium may comprise the tubing string. The use of a downhole medium to transmit a control signal may permit wireless transmission of the control signal.

The control signal may comprise an acoustic signal, such as an ultrasonic signal.

The control signal may comprise an electromagnetic signal, such as radio waves, microwaves, infrared, visible light, such as used in an optical signal, or the like.

The control signal may comprise a pressure pulse signal, such as a pressure pulse telemetry signal.

The control signal may comprise an electrical signal.

The control signal may be configured to be transmitted from a remote location.

The control signal may be transmitted from a surface or near surface location.

The control signal may be transmitted from a downhole location. The control signal may be transmitted from a downhole transmitter. The downhole transmitter may be permanently located downhole. For example, the downhole transmitter may form part of or be mounted on a downhole component, such as a tubing string.

The downhole transmitter may be configured to be deployed downhole. For example, the transmitter may be configured to be deployed on an elongate medium, such as wireline, slickline, coiled tubing or the like. The transmitter may be configured to be fluidly deployed downhole. For example, at least one transmitter may be provided within a capsule which is displaced downhole, for example internally or externally along a tubing string, for example by pumping, towards the location of the flow control device. The downhole transmitter may therefore be located within a transmission rage of the flow control device. This may permit a transmitter to be used with a smaller power source, for example.

The control signal may be uniquely addressed to the receiver. In this arrangement the flow control device may be configured to receive and identify a uniquely addressed signal. This may permit the flow control device to be used in combination with other devices which are configured to receive one or more control signals. The control signal may be uniquely addressed by use of a unique frequency component, such as a wave frequency, pulse frequency or the like.

The flow control device may be configured for use with a sensor arrangement configured to sense at least one downhole property. The at least one downhole properly may comprise temperature, chemical composition, conductivity, water saturation, interface properties, such as properties of an oil/water interface, carbon composition, oxygen composition, salinity, acoustic properties or the like.

The sensor arrangement may comprise a temperature sensor. The temperature sensor may comprise a distributed temperature sensor, such as an optical distributed temperature sensor.

The sensor arrangement may comprise a pressure sensor, such as a distributed pressure sensor, for example an optical distributed pressure sensor.

The sensor arrangement may be configured to function by communicating radioactivity towards a downhole region. Such a sensor may be configured for operation by gamma ray spectroscopy, such as in a carbon/oxygen sensor.

The sensor arrangement may be configured to determine a phase property of a downhole fluid. The sensor arrangement may be configured to permit a differentiation to be made between at least gas and liquid phases of a downhole fluid. The sensor arrangement may be configured to permit a differentiation to be made between different liquid components of a liquid phase, such as oil and water.

The sensor arrangement may comprise a multiphase flow meter.

The sensor arrangement may be configured for use in assisting determination of the required control of the flow path. In one embodiment the sensor arrangement may be configured to determine the existence of a fluid type at the location of the flow control device, and subsequently permit a control signal to be initiated to control the barrier member to vary the flow path. For example, the sensor arrangement may be configured to determine the presence of a fluid, such as water, which must be prevented from being communication through the flow path. In this case the barrier member may be controlled to close the flow path. This arrangement may advantageously be used in, for example, preventing water production from a formation.

The sensor arrangement may form part of the flow control device. Alternatively, the sensor arrangement may be provided separately of the flow control device.

The flow control device may be configured to be operated at least partially in accordance with a user. In this arrangement a user may initiate transmission of a control signal to operate the flow control device as desired. For example, a user may initiate transmission of a control signal when a fracturing operation is being performed.

The flow control device may be configured to be operated at least partially automatically, for example in accordance with predetermined conditions. For example, the flow control device may be operated in accordance with determined downhole conditions, such as flow conditions, chemical conditions, temperature conditions or the like. Such conditions may be determined using a sensor arrangement, such as the sensor arrangement described above.

The flow control device may comprise a transmitter. The transmitter may be configured to transmit one or more signals to a remote location, such as to a location of a user. This may permit information concerning the status of a flow control device, for example, to be transmitted to a user. The transmitter may be configured to transmit one or more signals to another device, such as another flow control device, pump arrangement or the like. In one embodiment the transmitter may be configured to transmit a control signal to another device, to permit a desired operation of said other device. For example, the transmitter may transmit a control signal to another device to instruct said other device to activate or deactivate. In one arrangement the flow control device may transmit a control signal to a pump to be deactivated following closure of the flow path.

According to a second aspect of the present invention there is provided a method of controlling flow between external and internal locations of a tubing string, comprising:

providing a flow control device having a flow path configured to permit flow between external and internal locations of a tubing string, and a barrier member configured to selectively vary the flow path; and locating the flow control device at a desired downhole location.

Advantageously, the method may comprise transmitting a control signal to the flow control device to permit control of the barrier member.

The method may comprise use of a flow control device according to the first aspect. Features and methods of use of the flow control device defined above may be considered to apply to the method according to the second aspect.

According to a third aspect of the present invention there is provided a completion assembly comprising:

a tubing string; and at least one flow control device according to the first aspect.

The completion assembly may comprise a plurality of flow control devices according to the first aspect. The plurality of flow control devices may all be configured for outflow, or may all be configured for inflow. Alternatively, at least one flow control device may be configured for outflow, and at least one other flow control device may be configured for inflow. At least one flow control device may be configured for both inflow and outflow.

The completion assembly may comprise a sealing arrangement, such as a zonal isolation sealing arrangement. The sealing arrangement may define a plurality of annular zones. The completion assembly may be configured such that flow of fluid into and/or out of each zone may be individually controllable by one or more of the flow devices.

The completion assembly may be operable to open the flow control devices associated with at least one zone in order to perform an inflow or outflow operation. The completion assembly may be operable to close the flow control devices associated with the at least one zone before opening the flow devices associated with at least one other zone.

According to a fourth aspect of the present invention there is provided a fracking valve assembly comprising:

a flow path configured to permit outflow of a fracking fluid from a tubing string;

a barrier member configured to selectively vary the flow path.

Advantageously, the fracking valve assembly may comprise a receiver configured to receive a control signal to permit control of the barrier member.

The fracking valve assembly may be configured in accordance with the flow control device according to the first aspect, and as such features defined above in relation to the first aspect may apply to the fracking valve assembly of the fourth aspect.

According to a fifth aspect of the present invention there is provided an inflow control device comprising:

a flow path configured to permit inflow of a formation fluid to a tubing string;

a barrier member configured to selectively vary the flow path.

Advantageously, the inflow control device may comprise a receiver configured to receive a control signal to permit control of the barrier member.

The inflow control device may be configured in accordance with the flow control device according to the first aspect, and as such features defined above in relation to the first aspect may apply to the inflow control device of the fifth aspect.

According to a sixth aspect of the present invention is a circulation valve comprising:

a flow path configured to permit inflow of a formation fluid to a tubing string;

a barrier member configured to selectively vary the flow path.

Advantageously, the circulation valve may comprise a receiver configured to receive a control signal to permit control of the barrier member.

The circulation valve may be configured in accordance with the flow control device according to the first aspect, and as such features defined above in relation to the first aspect may apply to the circulation valve of the sixth aspect.

According to a seventh aspect of the present invention is a distribution module for providing fluid from the tubing string to operate a flow control device according to the first aspect. The distribution module may be or comprise a hydraulic distribution module. The fluid from the tubing string may be or comprise pressurised fluid.

The hydraulic distribution module may comprise, be connected to or be configured to connect to a closing line. The hydraulic distribution module may comprise, be connected to or be configured to connect to an opening line. The hydraulic distribution module may be configured to selectively provide fluid from the tubing string to the opening line and/or closing line. The hydraulic distribution module may be configured to open and close the flow control device, e.g. by selectively providing fluid from the tubing string to one of the opening or closing line but not the other. The hydraulic distribution module may be configured to selectively bleed or allow fluid to escape from the other of the opening of closing line that is not being supplied with fluid from the tubing string.

BRIEF DESCRIPTION OF THE DRAWINGS

These and other aspects of the present invention will now be described, by way of example only, with reference to the accompanying drawings, in which:

FIG. 3(*b*) is a different cross section of a part the flow control device of FIG. 3(*a*) in a closed configuration;

FIG. 4(*b*) is a different cross sectional schematic representation of a part of a flow control device of FIG. 3(*a*) in a fracking configuration;

FIG. 5(*b*) is a cross sectional schematic representation of a part of a flow control device of FIG. 3(*a*) in an production configuration;

FIG. 6(*b*) is a schematic cross section of the flow control device of FIG. 6(*a*) in an opening configuration;

FIG. 6(*c*) is a schematic cross section of the control device of FIG. 6(*a*) in an open configuration;

FIG. 6(*d*) is a schematic cross section of the flow control device of FIG. 6(*a*) in a closing configuration;

FIG. 6(*e*) is a schematic cross section of the flow control device of FIG. 6(*a*) in a closed configuration;

FIG. 7(*b*) is a schematic cross section of the hydraulic distribution module of FIG. 7(*a*) in a first open configuration;

FIG. 7(*c*) is a schematic cross section of the hydraulic distribution module of FIG. 7(*a*) in a second closed configuration;

FIG. 7(*d*) is a schematic cross section of the hydraulic distribution module of FIG. 7(*a*) in a second open configuration;

FIG. 8(*b*) is a schematic cross section of the hydraulic distribution module of FIG. 8(*a*) in an open configuration;

FIG. 8(*c*) is a schematic cross section of the hydraulic distribution module of FIG. 8(*a*) in a reset configuration;

FIG. 8(*d*) is a schematic cross section of the hydraulic distribution module of FIG. 8(*a*) in a closed configuration;

FIG. 9(*b*) is a schematic cross section of the flow control device of FIG. 9(*a*) in a first open configuration;

FIG. 9(*c*) is a schematic cross section of the flow control device of FIG. 9(*a*) in a first reset configuration;

FIG. 9(*d*) is a schematic cross section of the flow control device of FIG. 9(*a*) in a second closed configuration;

FIG. 9(*e*) is a schematic cross section of the flow control device of FIG. 9(*a*) in a second reset configuration;

FIG. 9(*f*) is a schematic cross section of the flow control device of FIG. 9(*a*) in a second open configuration;

DETAILED DESCRIPTION OF THE DRAWINGS

Figure 1:
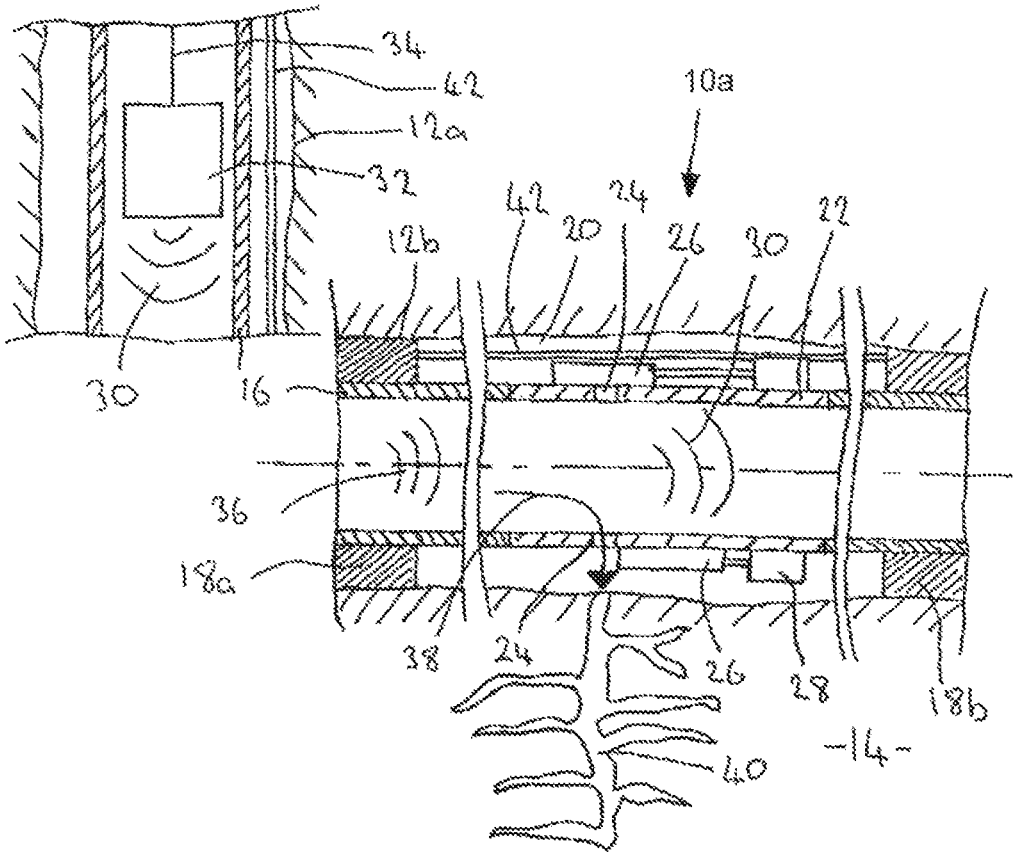
FIG. 1 is a diagrammatic representation of a flow control device in accordance with an embodiment of the present invention, shown deployed within a wellbore.

A downhole flow control device, generally identified by reference numeral 10*a*, is shown in FIG. 1 located within a wellbore 12 that has been drilled from the surface to intercept a subterranean formation 14. The wellbore 12 includes a vertical section 12*a* and a horizontal section 12*b*, wherein the flow control device 10*a* is shown located within the horizontal section 12*b*. In the embodiment shown, the flow control device 10*a* is configured as a fracking valve for use in permitting selective fluid communication of a fracking fluid into the formation 14, as will be described in further detail below.

The flow control device 10*a* is shown coupled to a tubing string 16 which provides fluid communication with a surface location. The tubing string 16 supports axially spaced packers 18*a*, 18*b* located on either side of the flow control device 10*a* to isolate an annular region 20 defined between the tubing string 16, flow control device 10*a*, wellbore 12 and packers 18*a*, 18*b*. Accordingly, the flow control device 10*a* is configured to permit selective communication of a fracking fluid from within the tubing string 16 to the isolated zone. In the embodiment shown, the packers 18*a*, 18*b* are swellable packers, but in other embodiments mechanical and/or inflatable packers may be used.

The flow control device 10*a* comprises a tubular body 22 which defines a flow path formed by a number of ports 24, and a barrier member in the form of a sleeve 26 which is axially slidable to vary the flow path by opening and closing the ports 24. The sleeve 26 may be configured between a closed position, as represented in the upper half of the device 10*a* in FIG. 1, and an open position, as represented in the lower half of the device 10*a* in FIG. 1, or at any position therebetween.

Figure 2:
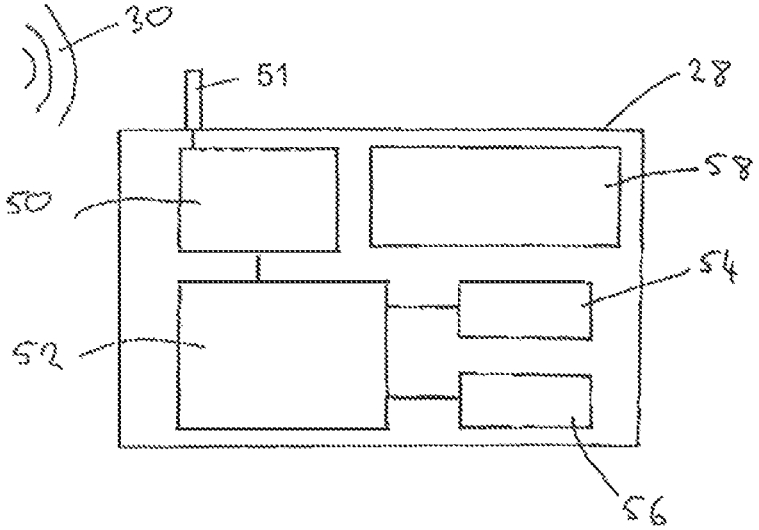
FIG. 2 is a diagrammatic representation of a control module of the flow control device of FIG. 1.

The device 10*a* further comprises a control module 28 which contains a receiver 50 (see FIG. 2) configured to receive an acoustic control signal 30 that is transmitted from an acoustic transmitter 32. A diagrammatic representation of the control module 28 is shown in FIG. 2, reference to which is additionally made. The module 28 comprises a receiver 50 and antenna 51 which are configured to receive the control signal 30, and communicate with an onboard programmable controller 52. The controller 52 is in communication with memory 54 which is interrogated to identify if the control signal 30 is addressed to operate the flow control device 10, The controller 52 is also in communication with an actuator controller 56 which is adapted to permit appropriate actuation of the sleeve 26 when instructed by the controller 56. The control module 28 also comprises a power source 58 which provides power for operation of the controller 56.

In the embodiment shown the acoustic transmitter 32 is shown deployed into the vertical wellbore section 12*a* on wireline and the control signal is communicated through a medium contained within the tubing string 16. In the embodiment shown the medium is a fluid medium, specifically a fracking fluid.

The control signal 30 is uniquely addressed to the device 10, and upon receipt the control module 28 initiates appropriate control of the sleeve 26 to open or close the ports 24 accordingly. As noted above, the control signal 30 is uniquely addressed to the flow control device 10, such that other control signals, such as control signal 36 intended for use in controlling another downhole device, will not interfere with the operation of the device 10.

In use, a requirement to open ports 24 may be met by deploying the transmitter 32 into the tubing string 16 and transmitting a signal 30 which is received by the receiver 50 within the control module 28, which then controls the sleeve 26 to slide to open the ports 24. This may be used to establish communication of a fracking fluid into the isolated annulus 20, as represented by arrow 38. As is known in the art, the fracking fluid penetrates the formation 14 to establish fractures and cracks 40 to increase the effective porosity of the formation 14 and thus the achievable flow rate of fluids therefrom.

Once the necessary fracturing operation has been performed the sleeve 26 may be again closed, for example by further transmission of an appropriate control signal. This may permit the tubing string 16 to be appropriately configured for production of fluids from the formation 14 to surface. In this respect the tubing string 16 may comprise additional ports which permit inflow of formation fluids. However, it should be noted that the ports 24 may remain open following a fracturing operation to permit the device 10 to function as an inflow control device to permit formation fluids to enter the tubing string 16 for production to surface.

As shown in FIG. 1, a cable 42, which may include one or more individual cables, may be run alongside the tubing string 16. The cable 42 may provide numerous functions. However, in the embodiment shown the cable 42 is configured for use in distributed temperature sensing and pressure sensing, for example using optical techniques. The cable 42 may therefore provide a user with information relating to the wellbore, such as production knowledge or the like. In this respect, knowledge derived from use of the cable 42 may instruct or otherwise assist in the control of the flow control device 26, or control of other devices associated with the wellbore 12.

The present invention provides significant advantages over prior art arrangements in which control of tracking valves is achieved by using balls or darts and hydraulic pressure. For example, the present invention permits the general inner diameter of the tubing string to be free of obstruction that would otherwise be presented by a ball or dart. Additionally, the present invention permits multiple operations of the device to achieve multiple configurations, for example to perform a re-fracking operation, which would otherwise need to be achieved by undertaking significant and undesirable workover or intervention operations to retrieve the ball or dart and reset the valve. Furthermore, the present invention does not require complex pumping arrangements and the like. Additionally, the present invention may permit deployment and control of multiple flow control devices without concerns relating to control of these device, for example because the tubing string may only permit use of a very small number of balls or darts to be used.

Figure 3:
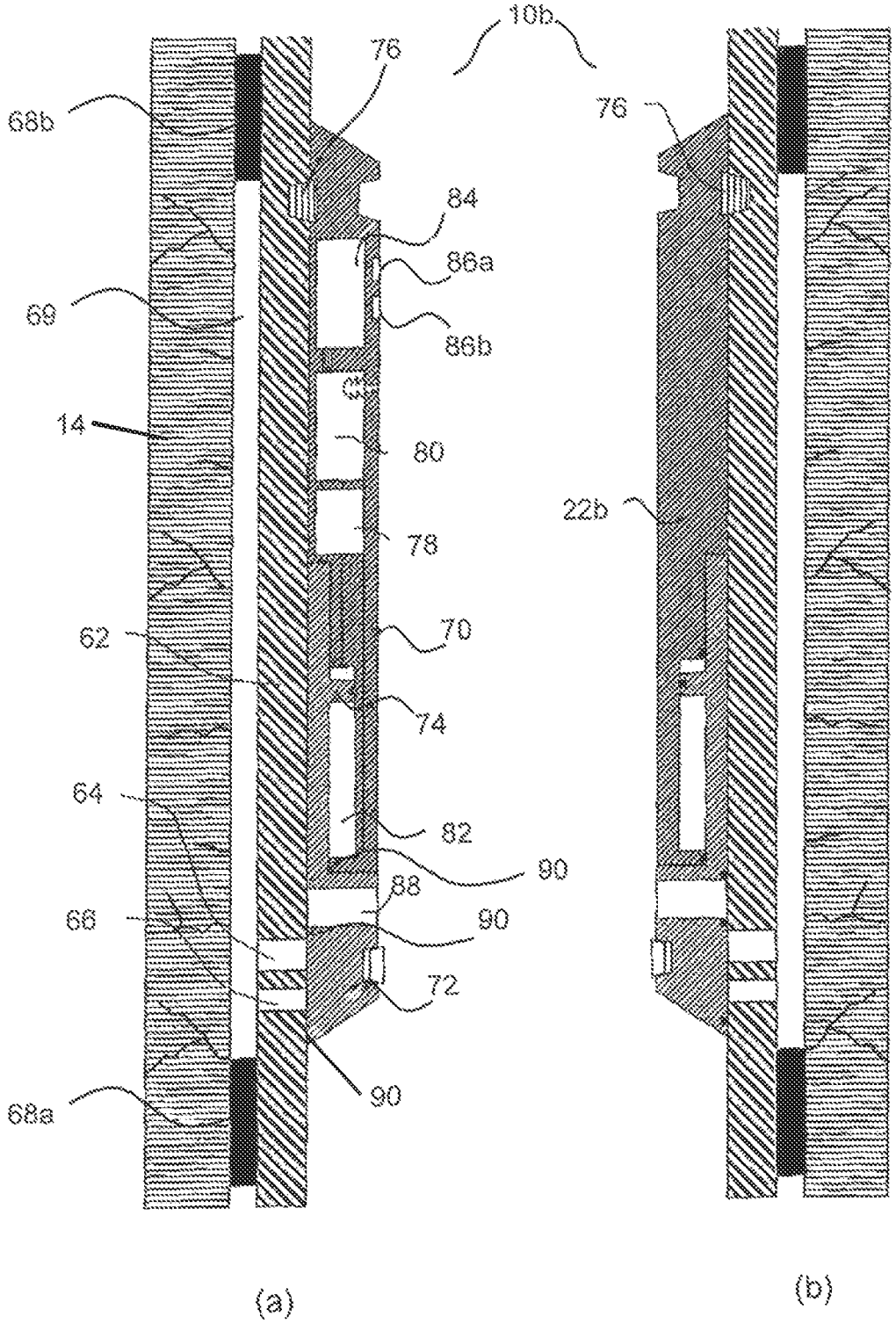
FIG. 3(*a*) is a cross sectional schematic representation of part of a flow control device according to an embodiment of the present invention in a closed configuration.
Figure 4:
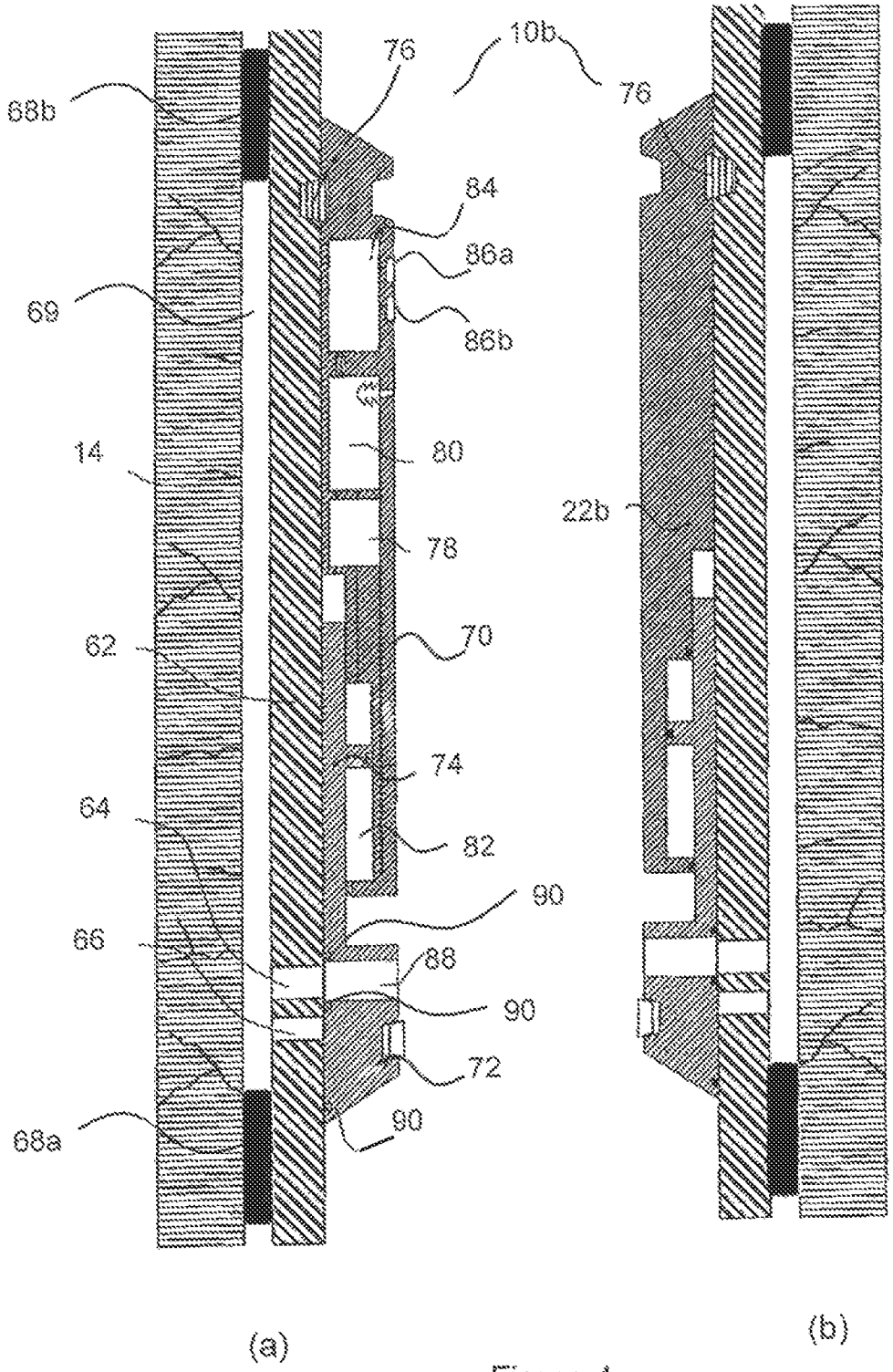
FIG. 4(*a*) is a cross sectional schematic representation of a part of a flow control device of FIG. 3(*a*) in a fracking configuration.
Figure 5:
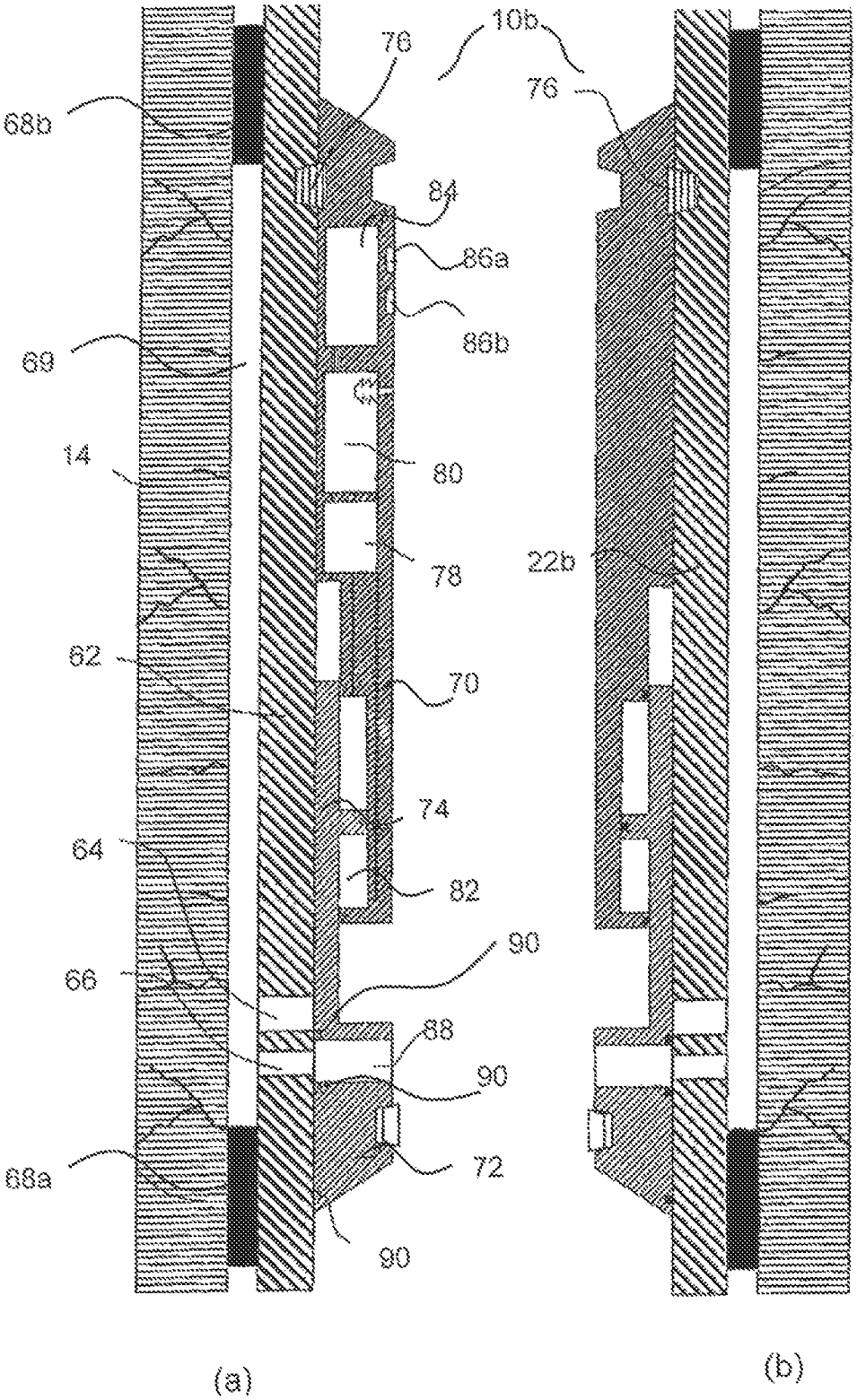
FIG. 5(*a*) is a cross sectional schematic representation of a part of a flow control device of FIG. 3(*a*) in a production configuration.
Figure 6A:
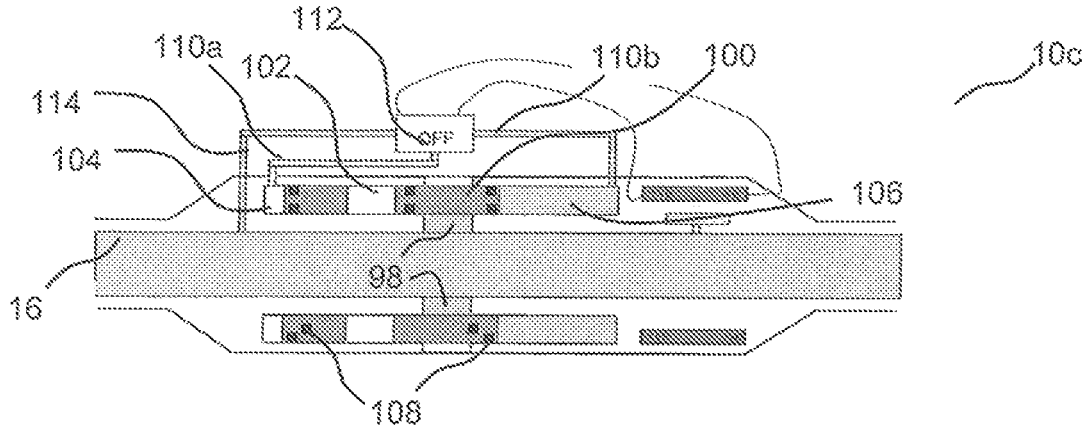
FIG. 6(*a*) is a schematic cross section of a flow control device in accordance with an embodiment of the present invention in a closed configuration.
Figure 6B:
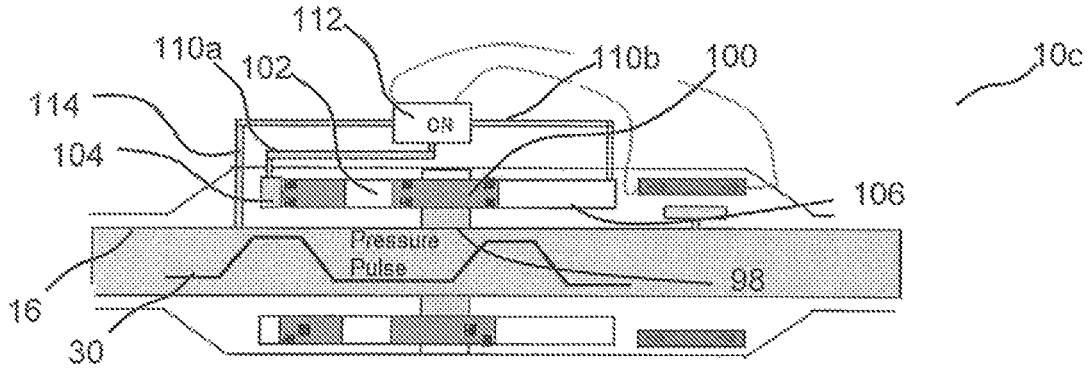
Figure 6C:
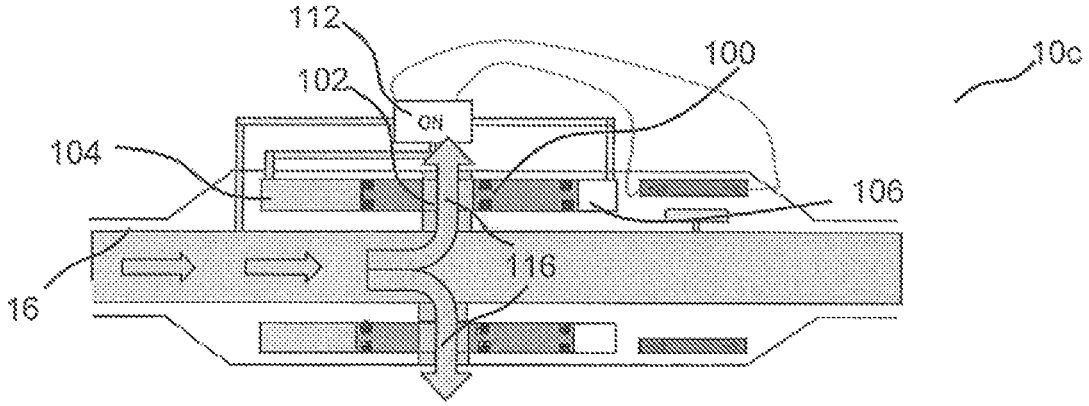
Figure 6D:
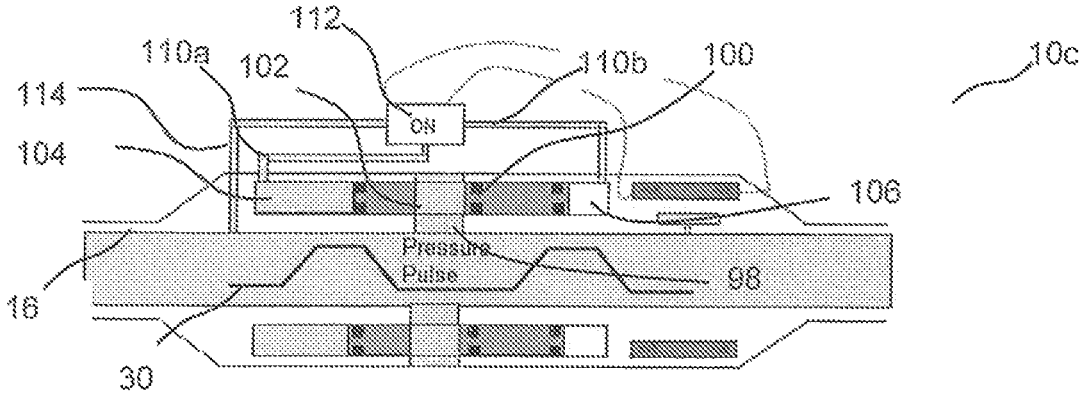
Figure 6E:
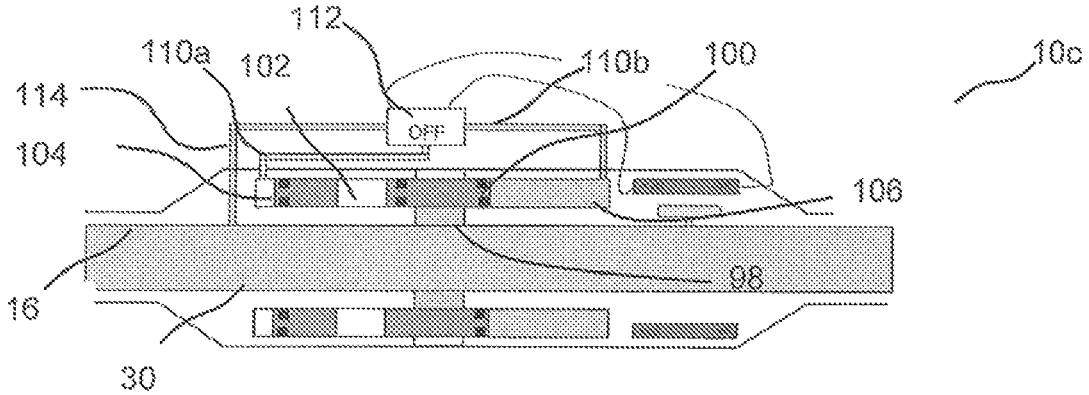

FIGS. 3 to 5 show an alternative flow control device 10*b*, which is remotely operable in a similar manner to the flow device 10*a* shown in FIG. 1. The alternative flow control device 10*b* is operable both as a tracking sleeve and as an inflow control device (ICD). The flow control device 10*b* is mountable onto a wellbore liner 62. One or more first ports 64 configured as frac ports and one or more second ports 66 configured as production ports extend through the wall of the liner 62. As is well understood in the art, the first and second ports 64, 66 can be different sizes depending on their function. For example, the frac ports 64 can have a larger diameter than the production ports 66.

The ports 64, 66 are provided between a pair of packers 68*a*, 68*b*, which seal between the liner 62 and the formation 14. In this way, the packers 68*a*, 68*b* close off a zone 69 of the annular space between the liner 62 and the formation 14, wherein the ports 64, 66 provide selective communication between the interior of the liner 62 and the zone 69 of the annular space.

The flow control device 10*b* comprises a tubular body 22*b* that includes a static sleeve portion 70 and a movable sleeve portion 72 that is slidably movable relative to the static sleeve portion 70 under the action of a hydraulic actuator 74. The static sleeve portion 70 is locked to the liner 62 by a selective sleeve lock 76. The static sleeve portion 70 houses a hydraulic distribution module 78 and a hydraulic power module 80 for selectively adjusting the pressure in a piston chamber 82, which in turn operates the actuator 74 to move the movable sleeve portion 72. The actuator 74 is operable responsive to a controller 84. The controller 84 is linked to communications receivers and sensors, such as pressure sensor 86*a* and acoustic sensor 86*b* that are operable to receive and decode acoustic control signals, such as the control signals 30 described above in relation to FIG. 1.

The movable sleeve portion 72 is provided with a through aperture 88. When aligned with either of ports 64, 66 in the liner 62, the through aperture 88 together with the respective port 64, 66 defines a flow channel between the interior of the liner 62 and the zone 69 of the annular space between the liner 62 and the formation 14. Seals 90 help to prevent bypassing of the sleeve aperture 88.

In this way, in a closed configuration, as shown in FIGS. 3(*a*) and 3(*b*), the aperture 88 in the movable sleeve portion 72 is positioned such that it is out of register with the ports 64, 66 in the casing, such that the ports 64, 66 are effectively closed by the movable sleeve portion 72. When the operator wishes to perform a fracking operation to open up the cranks 40 in the formation 14, an acoustic control signal 30 (see FIG. 1) is transmitted to the controller 84. Upon receipt of a suitably addressed control signal 30, the controller 84 operates the actuator 74 in order to slide the movable sleeve portion 72 relative to the static sleeve portion 70 so as to align the aperture 88 in the movable sleeve portion with the frac port 64 in the casing, as shown in FIGS. 4(*a*) and 4(*b*). Pressurised fracking fluid can then be ejected out from the liner via the sleeve aperture 88 and the frac port 64 in the liner 62. When the fracking operation is complete, another control signal can be sent to the controller 84, responsive to which the controller further operates the actuator 74 in order to close the frac ports 64 and subsequently align the sleeve aperture 88 with the production ports 66, as shown in FIGS. 5(*a*) and 5(*b*), in order to allow inflow of fluids, such as oil, from the formation 14 into the casing 62 through the production ports 66 and the sleeve aperture 88.

A flow control device 10*c* that advantageously does not require the dedicated hydraulic power module 80 of the flow control device 10*b* but instead uses pressurised fluid from the tubing string 16 to move the sleeve or barrier member is shown in FIGS. 6(*a*) to 6(*c*).

Advantageously, since the flow control device 10*c* is at least partially operable using fluid from the tubing string or wellbore, e.g. the pressure of which is used to set up pressure differentials which are usable to actuate a component of the flow device such as a barrier member or a part of an actuator for actuating the barrier member (e.g. to reset, compress or re-pressurise the actuator), then the flow control device 10*c* does not rely on batteries or power lines, which may be prohibitively expensive, or conventional pressure, atmospheric or spring power chambers, which may unduly limit the number of operations a valve can make.

In particular, the flow control device 10*c* captures energy from in-well pressures during operation in order to provide an energy source for the flow control device. Furthermore, the flow control device 10*c* does this in a manner that allows multiple operations of the flow control device 10*c* at a low cost.

In this embodiment, the flow control device 10*c* is provided around a tubing string 16. Ports 98 extend through the walls of the tubing string 16. The control device 10*c* comprises a movable barrier member in the form of a sleeve 100, wherein the sleeve 100 is provided with a through aperture 102. The sleeve 100 is slidable along the tubing string 16 such that the aperture 102 can be moved into and out of alignment with the port 98 in the tubing string 16. In this way, the port in the tubing string 16 can be selectively opened and closed by selectively moving the sleeve 100 of the flow control device 10*c*.

The flow control device 10*c* is provided with pressure chambers 104, 106 on either side of the sleeve 100, namely an opening chamber 104 and a closing chamber 106.

The sleeve 100 is provided with seals 108 at either end to prevent fluid in the pressure chambers 104, 106 bypassing the sleeve 100. Each of the pressure chambers 104, 106 are linked by a respective conduit 110*a*, 110*b* to a hydraulic distribution module 112. The hydraulic distribution module 112 is in turn linked by a conduit 114 to the interior of tubing string 16. In this way, fluid in the tubing string 16 can be supplied to the hydraulic distribution module 112, which is in turn configured to selectively connect the chambers 104, 106 to the interior of the tubing string 16 via the respective conduits 110*a*, 110*b* in order to selectively pressurise and depressurise the chambers 104, 106.

In particular, as shown in FIG. 6(*a*), when the closing chamber 106 is open to receive pressurised fluid from the tubing string 16 and the opening chamber 104 is not, then the resultant pressure differential between the chambers 104, 106 causes the sleeve 100 to move to the upstream side, thereby moving the aperture 102 out of alignment with the port 98 in the tubing string 16 and closing the port 98.

As shown in FIG. 6(*b*), in order to open the port 98, a control signal 30 in the form of a pressure pulse applied to the fluid in the tubing string 16, which can be detected by acoustic and/or pressure sensors 86*a*, 86*b* (see FIGS. 2 to 4) coupled to a controller 84. Responsive to the control signal 30, the opening chamber 104 is opened to the fluid in the tubing string 16 by the hydraulic distribution module 112 whilst the closing chamber 106 is allowed to drain. As a result, the pressure in the opening chamber 104 becomes greater than the pressure in the closing chamber 106. This pressure differential causes the sleeve 100 to move to the downstream side, thereby bringing the sleeve aperture 102 into alignment with the port 98 in the tubing string 16, as shown in FIG. 6(*c*). This opens the port 98, thereby allowing fluid communication between the inside of the tubing string 16 and the annular space, e.g. as shown by arrows 116.

As shown in FIG. 6(*d*), in order to close the port 98, a control signal 30 is transmitted to the flow control device 10*c* via a pressure pulse applied through the fluid in the tubing string 16 to the sensor 86*a*, 86*b*. Responsive to the control signal, the controller 84 (FIGS. 2 to 4) operates the hydraulic distribution module 112 such that the closing chamber 106 is connected to the inside of the tubing string 16 via the conduits 114 and 110*b*, whilst the conduit 110*a* to the upstream chamber is closed to the fluid pressure of the tubing string 16 and instead allowed to drain or dissipate, as shown in FIG. 6(*e*). As a result, the pressure in the closing chamber 106 becomes larger than in the opening chamber 104, thereby resulting in the sleeve 100 moving to the upstream side, bringing the aperture 102 out of alignment with the port 98 in the tubing to thereby close the port 98.

One embodiment of the hydraulic distribution module 112 is shown in FIGS. 7(*a*) to 7(*d*), which show a three chamber arrangement for providing the required fluid pressures to operate the sleeve 100. In this embodiment, the hydraulic distribution module 112 comprises an elongate chamber 120 that is closed at one end 122 and open to fluid pressure from the tubing string 16, e.g. hydrostatic or fracking pressure, at the other end 124. Three electronically releasable pistons 126*a* to 126*c* are provided which are initially spaced apart along the length of the chamber 120, each piston 126*a*, 126*b*, 126*c* being selectively fixable to an inner surface of the chamber 120, such that the chamber 120 is divided into three sub-chambers 128*a*, 128*b*, 128*c*. Suitable switchable fixing/releasing mechanisms for the pistons 126*a*-126*c* would be apparent to one skilled in the art such as electrical actuators, piezo electric elements, expandable, retractable and/or extendable members and/or the like. The sub-chambers 128*a* and 128*c* respectively closest to and furthest from the open end 124 of the chamber 120 are in fluid communication with respective sleeve opening lines 130, 132, whilst the middle chamber 129*b* is in communication with a sleeve closing line 134. The sleeve opening lines 130, 132 are attached to the opening pressure chamber 104 (see FIG. 6) at the opposite side of the sleeve 100 to the closing pressure chamber 106 to which the sleeve closing line 134 is attached. As described above in relation to FIG. 6, if the pressure in the opening chamber 104 is higher than the pressure in the opposing closing chamber 106, then the sleeve 100 is forced into an opened position, whereas the sleeve 100 is forced into a closed position if the pressure in the closing chamber 106 is higher than the pressure in the opposing opening chamber 104.

Each of the pistons 126*a*, 126*b*, 126*c* grips and seals the chamber 120 but are remotely releasable. Releasing the pistons 126*a*, 126*b*, 126*c* breaks the grip of the piston 126*a*, 126*b*, 126*c* against the inner surface of the chamber 120 and allows the piston 126*a*, 126*b*, 126*c* to be driven by pressure differentials across the piston 126*a*, 126*b*, 126*c*.

Figure 7A:
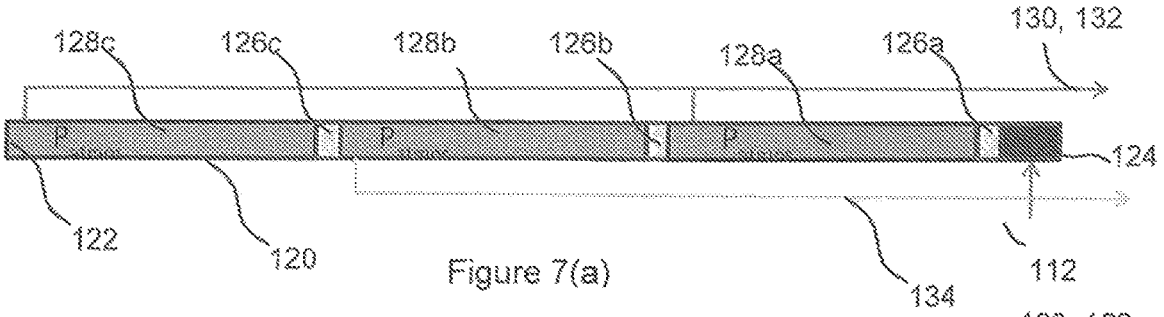
FIG. 7(*a*) is a hydraulic distribution module for controlling fluid pressure supplied to the flow control device of FIG. 6(*a*), the hydraulic distribution module being in a first closed configuration.
Figure 7B:
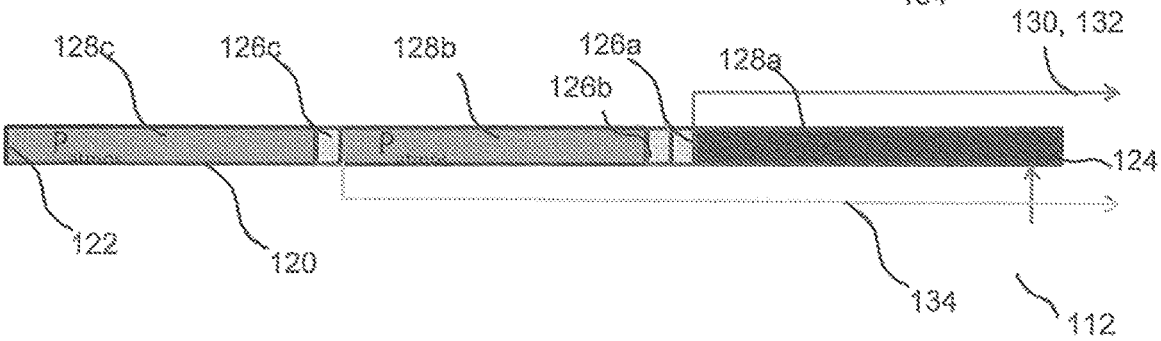
Figure 7C:
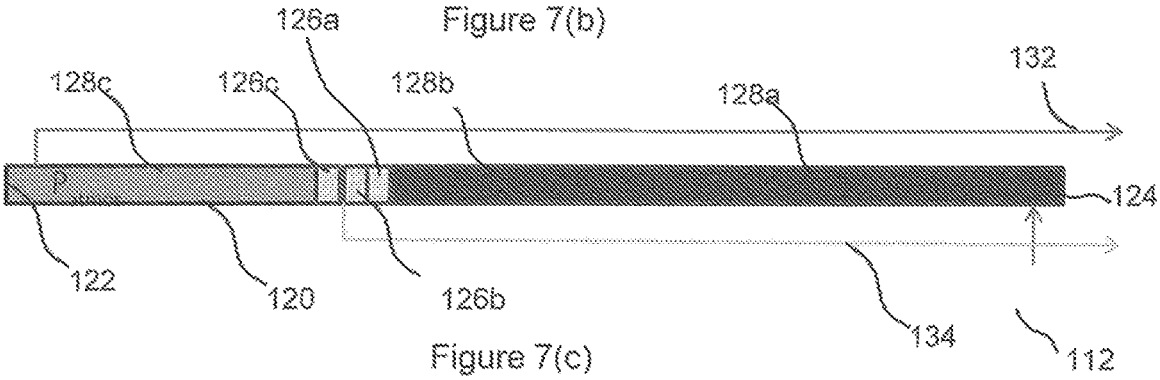
Figure 7D:
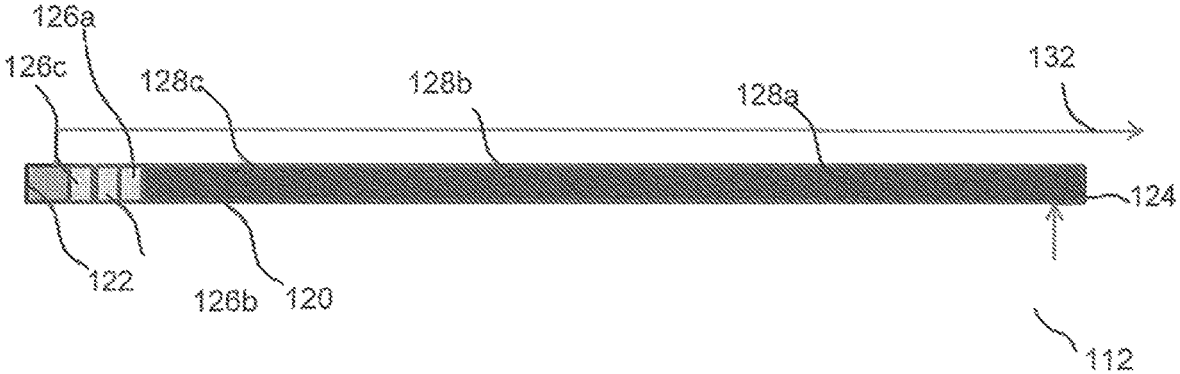

In an initial condition, each of the sub-chambers 128*a*, 128*b* and 128*c* are filled with fluid at atmospheric pressure for example, as shown in FIG. 7*a*. However, in the initial configuration, one face of the first piston 126*a* is exposed to hydraulic or fracking pressure from the tubing string 16, which is greater than atmospheric pressure, thereby setting up a pressure differential across the first piston 126*a*.

In this way, when the user wishes to open the port 98, the first piston 126*a* can be electronically released, whereupon the first piston 126*a* will be forced away from the open end 124 of the chamber 120, towards the second piston 126*b*, as shown in FIG. 7(*b*). This exposes the first sub-chamber 128*a* to the high pressure hydraulic or fracking fluid from the tubing string 16, which thereby pressurises the opening chamber 104 of the flow control device 10*c* (see FIG. 6) via the line 130 in order to move the sleeve 100 to the open position.

As shown in FIG. 7(*c*) the hydraulic distribution module 112 can be suitably configured such that subsequently releasing the second piston 126*b* can be used to move the sleeve 100 back to the closed position by exposing the second sub-chamber 128*b* to high pressure fluid, such as hydraulic or fracking fluid, so as to increase the pressure of the closing chamber 106 via the line 134.

The hydraulic distribution module can also be suitably configured such that subsequently releasing the third piston, as shown in FIG. 7(*d*), exposes the third sub-chamber 128*c* and thereby the opening chamber 104 of the flow control device 10*c* to high pressure hydraulic or fracking fluid via the line 132 to thereby move the sleeve 100 back into the open position.

Figure 8:
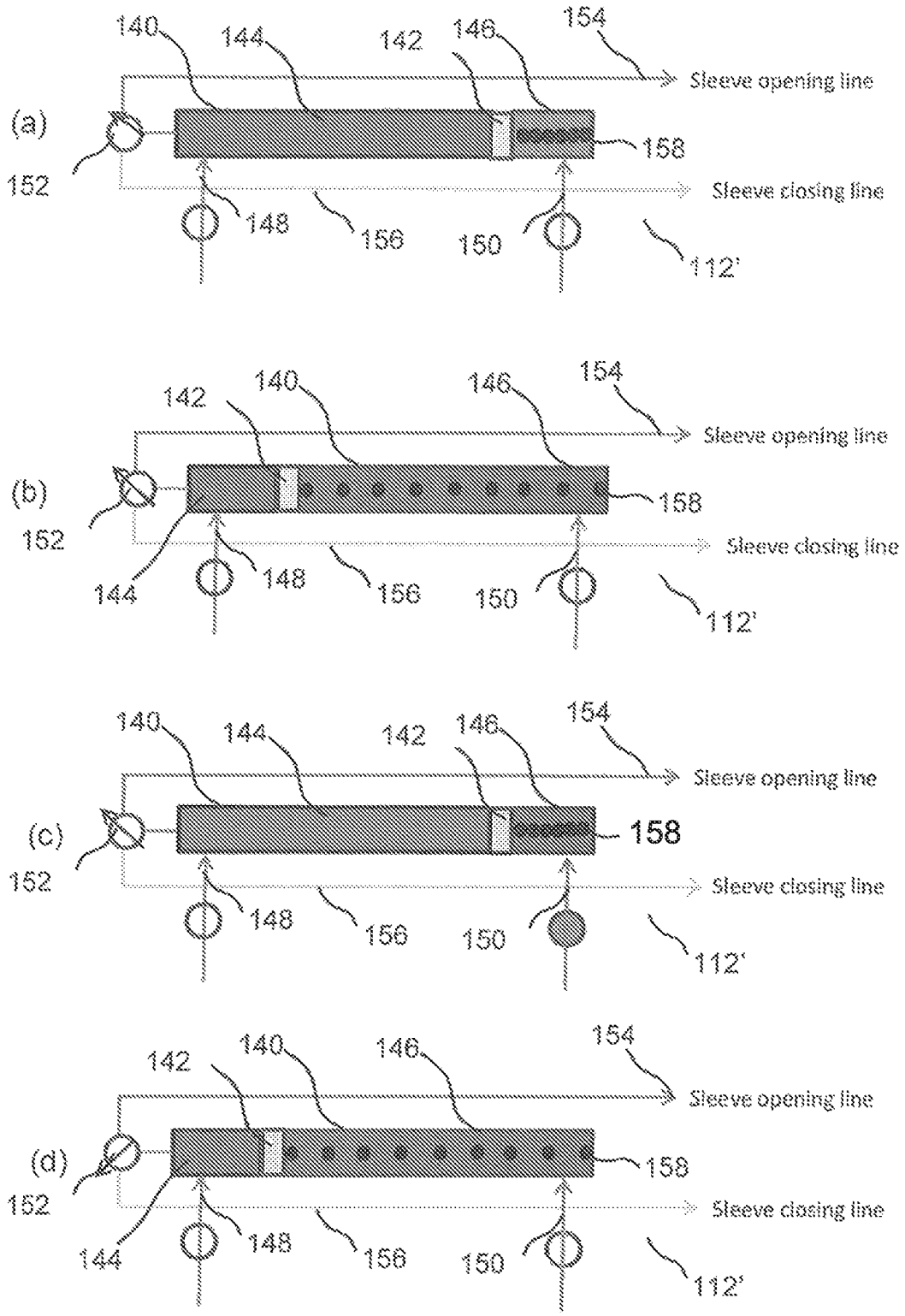
FIG. 8(*a*) is a schematic cross section of part of a hydraulic distribution module for controlling fluid pressure supplied to the flow control device of FIG. 6(*a*), the hydraulic distribution module being in a closed configuration.

Another embodiment of the hydraulic distribution module 112' is shown in FIGS. 8(*a*) to 8(*d*). In this embodiment, the hydraulic distribution module 112' is a single chamber hydraulic distribution module, rather than the triple chamber hydraulic distribution module 112 shown in FIG. 7.

The hydraulic distribution module 112' of FIG. 8 comprises an elongate chamber 140 in which a piston 142 is mounted so as to be slidable axially within the chamber 140. The piston 142 is configured to selectively grip the inner surface of the chamber 140 and seal the chamber 140. The piston 142 seals against and is selectively fixable to and releasable from the inner surface of the chamber 140, e.g. responsive to an electronic signal. Again, suitable remotely operable selective fixing/releasing mechanisms would be apparent to the relevant skilled worker, as described above.

The piston 142 separates the chamber 140 into two sub-chambers 144, 146. The chamber 140 is provided with a valve controlled inlet 148, 150 at each end, such that one of the inlets 148 is in communication with the first sub chamber 144 and the other inlet 150 is in communication with the second sub-chamber 146. An end of the first sub-chamber 144 is also provided with a valve controlled outlet 152. The valve of the valve controlled outlet 152 is a three port valve that is switchable so as to selectively connect either a sleeve opening line 154 or a sleeve closing line 156 to the first sub-chamber 144. The sleeve opening line 154 is connected to the opening chamber 104 of the flow control device 10*c* (see FIG. 6) and the sleeve closing line 156 is connected to the closing chamber 106 of the flow control device 10*c*.

Biasing means 158, such as a spring or a resiliently compressible member, is provided in order to bias the piston toward the end of the chamber 140 in which the outlet 152 is located.

As shown in FIG. 8(*a*), in an initial condition, the biasing means 158 is compressed and the piston 142 selectively grips the inner surface of the chamber 140 so as to be locked in position. Both sub chambers 144, 146 are at hydrostatic pressure. The outlet valve 152 is arranged to open the sleeve opening line 154 to the first sub-chamber 144.

When the user wishes to open the flow control device 10*c* (see FIG. 6), then the grip of the remotely releasable piston 142 can be released so that it can slide within the chamber 140, as shown in FIG. 8(*b*). Since the biasing means 158 is compressed, it exerts a force that pushes the piston 142 towards the outlet 152, increasing the pressure in the first sub-chamber 144 and thereby also increasing pressure in the opening pressure chamber 104 of the flow control device 10*c* via the sleeve opening line 154. In this way, the sleeve 100 is moved into a position in which the flow control valve 10*c* is open.

The hydraulic distribution module 112 is resettable by providing a fluid to the first sub-chamber 144 via the inlet 148 at a high enough pressure to force the piston 142 back in order to re-compress the biasing means 158. For example, fluid at a pressure used during fracking can advantageously be utilised for this purpose. In this way, the flow control device 10*c* can be opened and used for a fracking process and the highly pressurised fracking fluid can be used to reset the biasing means 158 without having to supply a separate fluid specifically for this purpose. Once the biasing means 158 has been compressed, the piston 142 can be selectively configured to grip the walls of the chamber 140 such that it is again ready for operation.

If the user wishes to close the flow control device 10*c*, e.g. once fracking has been completed, then, as shown in FIG. 8(*d*), the valve of the outlet 152 can be switched to selectively connect the closing line 156 to the first sub-chamber 144. The pressure in the first sub-chamber 144 can be returned to hydraulic pressure via provision of suitable fluid via the first calve controlled inlet 148. The piston 142 can then be selectively released, e.g. responsive to an electronic signal from a remote transmitter, so as to be movable within the chamber 140 whereupon the biasing means 158 drives the piston towards the outlet, thereby pressuring the closing line 156 and thus the closing pressure chamber 106 in order to force the sleeve 100 into the closed position.

Figure 9:
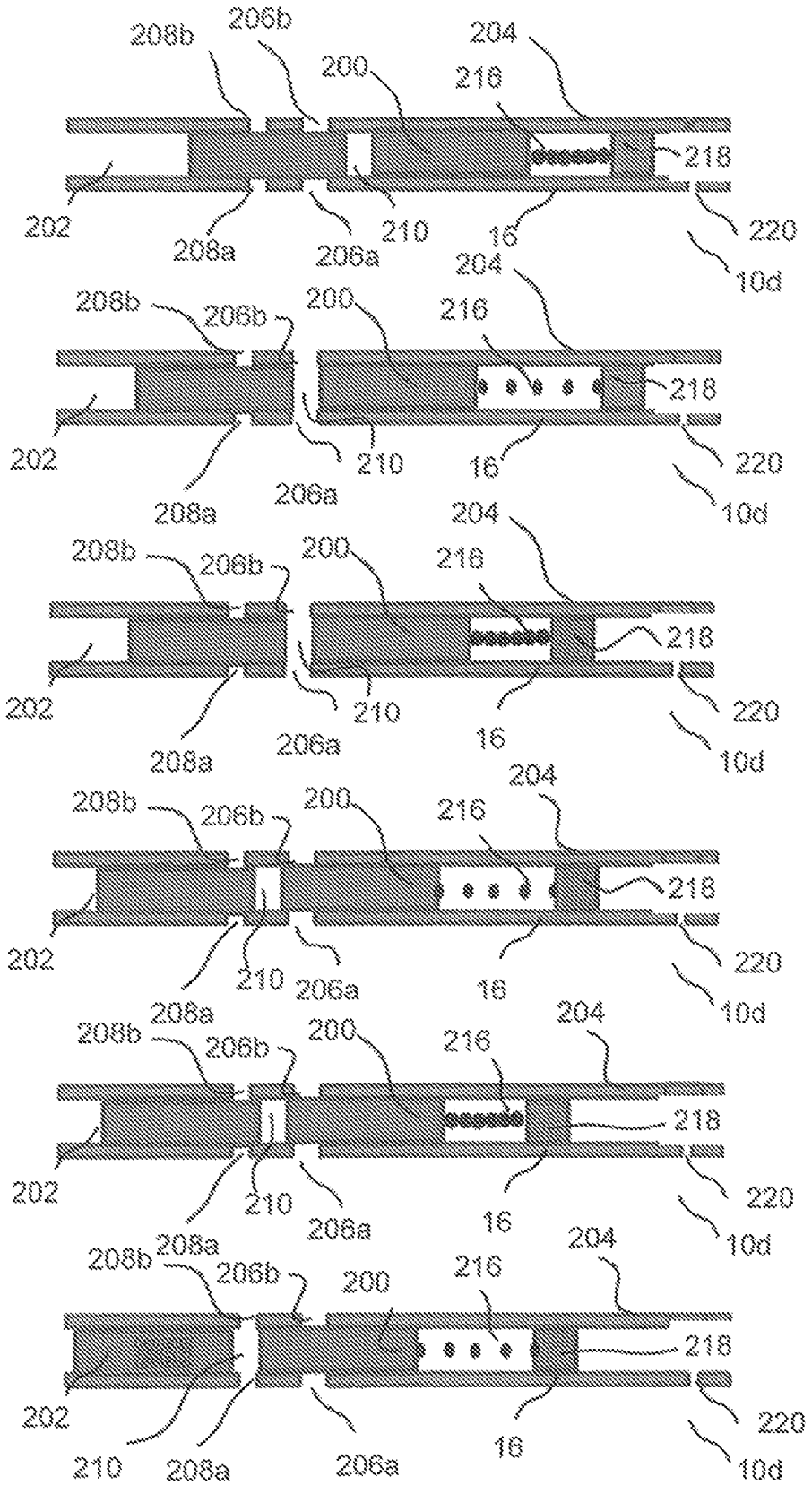
FIG. 9(*a*) is a schematic cross section of part of a flow control device in accordance with an embodiment of the present invention in a closed or initial configuration.

A particularly advantageous embodiment of a unidirectional flow control device 10*d* is shown in FIG. 9, which shows a cross section through one wall of a cylindrical tubing string and casing. Like the embodiment of FIGS. 6(*a*) to 6(*d*), this flow control device 10*d* is at least partially operable using fluid from the tubing string or wellbore in a manner that allows multiple operations of the device.

In this embodiment, a barrier member 200 such as a sleeve, piston or plunger is provided in an annular space 202 between the outer surface of the tubing string 16 and an inner surface of an outer tubular or casing 204. Each of the tubing string 16 and the outer tubular or casing 204 have first ports 206*a*, 206*b* (such as fracking ports) and second ports 208*a*, 208*b* (such as production ports), wherein the first ports 206*a* of the tubing string are aligned radially with corresponding first ports 208*a* of the outer tubular or casing 204 and the second ports 206*b* of the tubing string are aligned radially with corresponding second ports 208*b* of the outer tubular or casing 204.

The barrier member 200 is configured to selectively grip, and seal between, the inner surface of the outer tubular or casing 204 and the outer surface of the tubing string 16. For example, the barrier member 200 may comprise electrically or hydraulically powered actuators for selectively and controllably gripping and releasing from the tubing string 16 and the outer tubular or casing 204. In this way, the piston is selectively switchable between a configuration in which it is locked or fixed in position and a configuration in which it is slidable longitudinally along the annular space 202.

The barrier member 200 is provided with a through aperture 210 that can be selectively aligned with the first ports 206*a*, 206*b* on the tubing string 16 and outer tubular or casing 204 in order to form a first flow path and selectively aligned with the second ports 208*a*, 208*b* on the tubing string 16 and outer tubular or casing 204 in order to form a second flow path by sliding the barrier member 200 along the tubing string 16.

The barrier member 200 is coupled with a force applying device 216 which acts between the barrier member 200 and a piston 218. In this case, the force applying device 216 is a spring, but it will be appreciated that other force applying devices such as a resiliently deformable member or hydraulic pressure device, or the like could be used.

A pressure port 220 is provided in the wall of the tubing string 16 on an opposite side of the piston 218 to the barrier member 200. In this way, fluid from the tubing string 16 can exert a pressure on one face of the piston 218.

In an initial configuration, as shown in FIG. 9(*a*), the piston 218 and barrier member 200 grip the outer surface of the tubing string 16 and the inner surface of the outer tubular or casing 204, the force applying device 216 is in a compressed configuration and the aperture 210 of the barrier member 200 is out of alignment with the first and second ports 206*a*, 206*b*, 208, 208*b*, such that the barrier member 200 seals the first and second flow paths closed.

In order to carry out a fracking process, the first flow path is opened by releasing the barrier member 200 such that it no longer grips the tubing string 16 or outer tubular or casing 204. Since the force applying means 216 exerts a force between the fixed piston 218 and the now movable barrier member 200, the barrier member 200 is slid away from the piston 218, thereby bringing the sleeve aperture 210 into alignment with the first (i.e. frac) ports 206*a*, 206*b*. In this way, the first flow path through the frac ports 206*a*, 206*b* from the interior of the tubing string 16 to the exterior of the outer tubular or casing 204 is opened, as shown in FIG. 9(*b*). This allows high pressure fluid to be emitted out from the tubing string 16 via the flow path 212 in order to perform a fracking procedure.

In order to reset the flow control device 10*d*, the barrier member 200 can be switched into a locked configuration wherein it grips the tubing string 16 and/or outer tubular or casing 204 and the piston 218 is released such that it is movable relative to the tubing string 16 and outer tubular or casing 204. Since the piston 218 is exposed to the pressure exerted by fluid from the tubing string 16 via the pressure port 220, the piston 218 is forced towards the barrier member 200, thereby compressing or pressurising the force applying device 216, as shown in FIG. 9(*c*). Thereafter, the piston 218 can be selectively configured to grip the tubing string 16 and/or outer tubular or casing 204 such that the flow control device is again set for operation.

Once the fracking process is completed, the flow control device 10*d* can be placed in a closed configuration by releasing the barrier member 200. As a result, the sleeve is moved under the action of the force applying device 216 in order to move the sleeve aperture 210 out of register with the first and second ports 206*a*, 206*b*, 208*a*, 208*b* so as to close the first flow path, as shown in FIG. 9(*d*).

The flow control device 10*d* can then be reset again by switching the sleeve into a locked configuration in which it grips the tubing string 16 and the outer tubular or conduit 204 and releasing the piston 218, such that it is movable relative to the tubing string 16 and the outer tubular or conduit 204. As described above, the pressure from the fluid in the tubing string 16 then acts on the piston 218 via the pressure port 220 in order to drive the piston 218 towards the barrier member 200, thereby re-compressing or pressuring the force applying device 216, as shown in FIG. 9(*e*).

In order to open the flow control device 10*d* again, e.g. as part of a production phase, the second flow path 214 is opened by releasing the barrier member 200 whilst the piston 218 is in the locked configuration in which it grips the tubing string 16 and the outer tubular or casing 204. This allows the sleeve 100 to be slid away from the piston under the action of the force applying device 216, thereby bringing the sleeve aperture 210 into alignment with the second (i.e. production) ports 208*a*, 208*b* to thereby open the second flow path 214 from the interior of the tubing string 16 to the exterior of the outer tubular or casing 204, as shown in FIG. 9(*f*).

It will be appreciated from the above, that this embodiment advantageously provides a flow control device 10*d*, in which the sleeve is unidirectionally movable in order to alternately open and close the flow control device 10*d* under the action of a force applying device 216. The unidirectional device 10*d* beneficially allows the device to be operated with a single pressuring chamber/surface (i.e. the chamber formed by the annular space 202 and the piston 218). The force applying device 216 can be reset using the pressure of the fluid from the tubing string 16. In this way, the flow control device 10*d* is operable using a "caterpillar" type movement, in which one of the barrier member 200 and piston 218 are fixed and the other is released in order to release and reset the force applying device 216. This results in the barrier member 200 moving along the conduit in the same direction to open and close the first and second flow paths. It will be appreciated that this arrangement advantageously uses fluid pressure from the tubing string 16 to move the barrier member 200 and does not require separate hydraulic propulsion fluid or a propulsion apparatus such as a motor.

It will be appreciated that flow control devices such 10*a*-10*d* such as those described above can be used in variety of applications. Use of multiple flow control devices is illustrated in FIG. 10, reference to which is now made.

Figure 10:
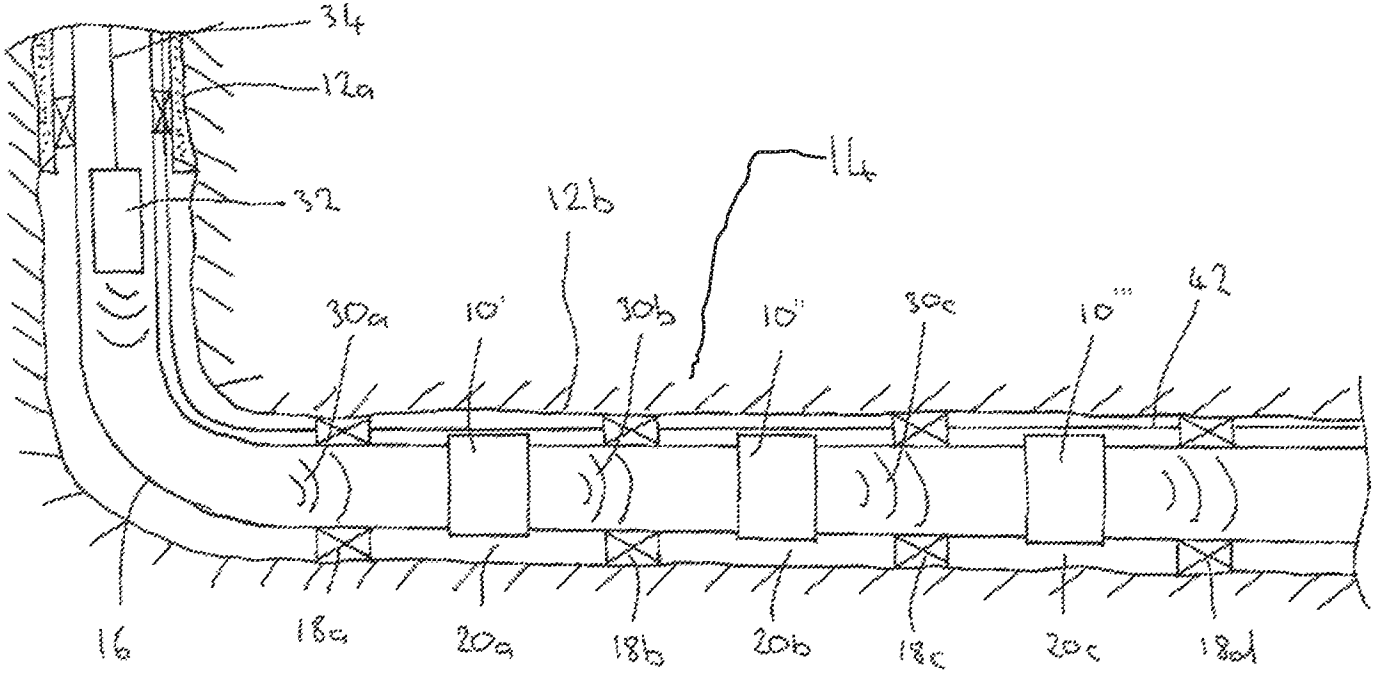
FIG. 10 is a diagrammatic representation of a completion string which includes a plurality of flow control devices, such as those of FIG. 1 or 3 to 6 or 9.

In FIG. 10 the tubing string 16 extends through both vertical and horizontal portions 12*a*, 12*b* of a wellbore to extend from the surface to intercept the formation 14. The tubing string 16 includes a plurality (three shown in FIG. 3) of flow control devices 10', 10", 10'" which are each configured in accordance with the flow control device 10*d* of FIG. 9, and as such no further specific description will be given. However, it will be appreciated that any of the other flow control devices 10*a* to 10*c* described above, or variations thereof, could be used instead. Each flow control device 10', 10", 10'" is located within respective isolated annular zones 20*a*, 20*b*, 20*c* formed by packers 18*a*, 18*b*, 18*c*, 18*d*. A distributed cable sensor 42 extends along the length of the tubing string 16 to permit sensing of temperature and pressure.

Each device 10', 10", 10'" is configured to be operated upon receipt of a respective acoustic control signal 30*a*, 30*b*, 30*c* transmitted by an acoustic transmitter 32 deployed into the vertical wellbore section 12*a* on wireline 34. In this way each device 10*a*, 10*b*, 10*c* can be operated as desired, for example simultaneously, sequentially or the like. This may permit custom operations, such as formation stimulations to be performed within the wellbore, with full coverage being provided in extended reach horizontal wellbore.

Figure 11:
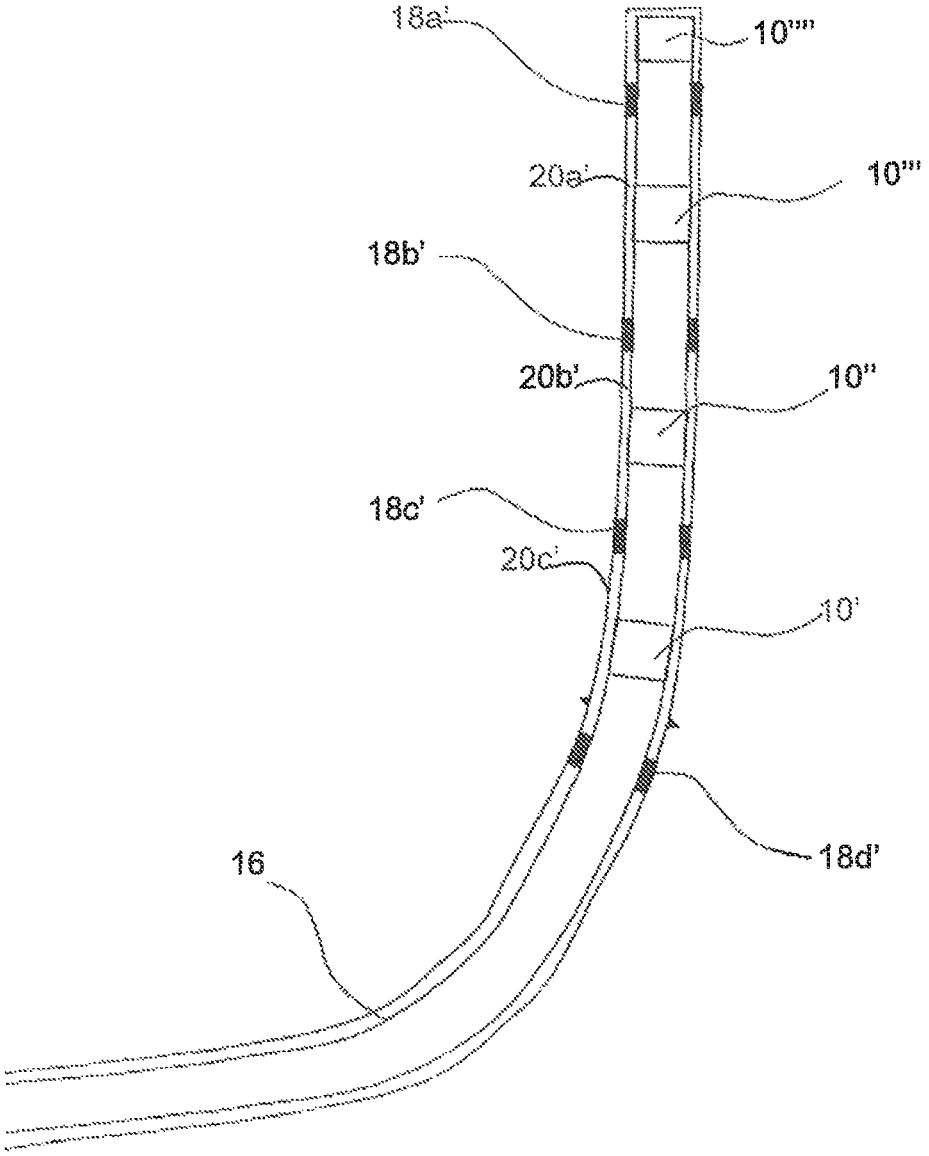
FIG. 11 is a diagrammatic representation of an alternative completion string which includes a plurality of flow control devices, such as those of FIG. 1 or 3 to 6 or 9.

Another example of the use of multiple flow control devices, such as the flow control devices 10*a*-10*d* described above is shown in FIG. 11. In this case, several (in this case four) flow control devices 10', 10", 10'", 10"" are provided along the length of production tubing and within a casing. Again, each flow control device is provided in an associated isolated annular zone 20*a*', 20*b*', 20*c*' formed using packers 18*a*', 18*b*', 18*c*', 18*d*'. The flow control device 10"" provided at the distal or toe end of the wellbore is closed at one end such that it is operable as a circulation valve.

In this way for example, the flow control valves 10', 10", 10'", 10"" can be sequentially opened and closed from the distal or toe end of the wellbore to the proximate or head end to permit a fracking operation to be carried out in the associated zone 20*a*', 20*b*', 20*c*' before being closed again before the next flow control valve 10', 10", 10'", 10"" is opened. In this way, only the flow control valve associated with a particular zone 20*a*', 20*b*', 20*c*' can be opened to allow selective fracking in that zone 20*a*', 20*b*', 20*c*' and then closed before the flow control device 10', 10", 10'", 10"" in another zone is opened in order to conserve fluid pressure. After the fracking is completed, then some or all of the flow control devices 10', 10", 10'", 10"" can be opened in order to allow production.

It should be understood that the embodiments described herein are merely exemplary and that various modifications may be made thereto without departing from the scope of the invention.

For example, although force applying devices in the form of springs are described, it will be appreciated that other force applying devices, such as resiliently deformable members, or compressible hydraulic chambers or rams may be used instead.

Furthermore, alternate pressure applying means or force applying devices, such as those that apply a pressure via a selective chemical reaction, effervescing, thermal release, slow burning or the like could be used.

In addition, any suitable signal may be used to control the flow control device, such as an electromagnetic signal, pressure pulse telemetry, electrical signal, optical signal or the like.

Additionally, in the embodiments shown, the control signals are generally represented as being transmitted through a medium contained within the tubing string. However, in other arrangements the control signal may be communicated through one or more cables, such as electrical cables, fibre optic cables or the like.

Additionally, or alternatively, the control signal may be communicated through other components located within the wellbore, such as the tubing string, and/or may be communicated through the formation 14 and/or surrounding earth.

Furthermore, the flow control device in the embodiment shown in configured as a fracking valve. However, in other embodiments the flow control device may define an injection valve, an inflow control device (ICD) or the like.

Additionally, in FIG. 10 all flow control devices are configured as fracking valves. However, in other embodiments some devices may be configured as fracking valves and some may be configured as inflow control devices, or all devices may be configured as inflow control devices.

Also, the flow control device is represented as comprising a sleeve which is used to selectively open and close radial ports within a tubular body. However, various alternative configurations may be possible, such as internally located components, valve members, tortuous flow paths, pistons, plungers or the like.

Further, the control signal may be alternatively, or additionally transmitted from surface, and/or may be transmitted from a transmitter which is permanently located within the tubing string.

Furthermore, the switchable/selective gripping/releasing mechanism of the pistons or members, such as the barrier member or sleeve and counter member, can be provided by any of a variety of suitable mechanisms, such as actuators, expandable/compressible members, piezo electric members, fillable/drainable or pressurisable/depressurisable chambers, electromagnetic devices, mechanical switches, micro-hydraulic grippers, shearable members, solenoid valves, spring loaded plugs and/or the like.

In addition, although the flow control device of the present invention is advantageously wirelessly remotely controllable, e.g. via pressure pulse telemetry, for example, by varying the pump rate used to pump fluid into the tubing string or wellbore during operations to encode a control signal, and without mechanical intervention, it will be appreciated that, in optional embodiments, the devices could be additionally movable via mechanical interventions.

Although references are made to fracking or fracturing or "frac", e.g. as in a frac port, it will be appreciated by a person skilled in the art that these terms are equivalent and refer to the same process.

The invention claimed is:

1. A downhole flow control device configured for use with a tubing string, comprising:

a flow path configured to permit flow between external and internal locations of a tubing string;

a barrier member being selectively moveable by fluid pressure from an interior of the tubing string or a wellbore to open and close the flow path;

an opening chamber on a first side of the barrier member, wherein fluid pressure from the interior of the tubing string or wellbore applied within the opening chamber acts to bias the barrier member towards its open position;

a closing chamber on a second side of the barrier member, wherein fluid pressure from the interior of the tubing string or wellbore applied within the closing chamber acts to bias the barrier member towards its closed position;

a hydraulic distribution module in pressure communication with the interior of the tubing string or wellbore via a first pressure communication path, wherein the hydraulic distribution module is configured to selectively communicate fluid pressure from the interior of the tubing string or wellbore to the opening and closing chambers, the hydraulic distribution module being configurable between a first configuration in which the hydraulic distribution module communicates pressure from the interior of the tubing string or wellbore to the opening chamber via a second pressure communication path, such that said pressure from the interior of the tubing string or wellbore acts on the barrier member to cause said barrier member to move in a direction to open the flow path, and a second configuration in which the hydraulic distribution module communicates pressure from the interior of the tubing string or wellbore to the closing chamber via a third pressure communication path, such that said pressure from the interior of the tubing string or wellbore acts on the barrier member to cause said barrier member to move in a direction to close the flow path; and a receiver configured to receive a control signal to permit control of the barrier member.

2. The downhole flow control device according to claim 1, wherein the hydraulic distribution module comprises:

an elongate chamber;

a plurality of pistons within the elongate chamber, wherein the pistons are selectively fixable to an inner surface of the elongate chamber;

a plurality of sub chambers at least partially defined between the plurality of pistons, wherein at least one sub-chamber is in pressure communication with the interior of the tubing string or wellbore, at least one sub chamber is in pressure communication with the opening chamber and at least one sub chamber is in pressure communication with the closing chamber.

3. The downhole flow control device according to claim 1, wherein the fluid pressure comprises at least one of a fracking pressure and a hydraulic fluid pressure.

4. The downhole flow control device according to claim 3, wherein the barrier member is selectively movable by a fluid pressure differential between a fracking fluid pressure and at least one of a hydraulic, wellbore and atmospheric pressure.

5. The downhole flow control device according to claim 1, wherein the barrier member is unidirectionally movable in order to open or close the flow path.

6. The downhole flow control device according to claim 1, wherein the barrier member is operable to selectively grip and/or release the tubing string.

7. The downhole flow control device according to claim 6, wherein the flow control device is configured to selectively vary the flow path by selectively releasing the barrier member.

8. The downhole flow control device according to claim 1, wherein the barrier member comprises a sleeve and at least one port is provided in the barrier member, the barrier member being movable such that the at least one port in the barrier member is selectively at least partially alignable with at least one port in the tubing string in order to vary the flow path.

9. The downhole flow control device according to claim 1, wherein the receiver is configured to receive a control signal transmitted via a communication path.

10. The downhole flow control device according to claim 9, wherein the communication path is at least partially defined by a downhole medium including at least one of a downhole fluid, a geological structure, downhole equipment and the tubing string.

11. The downhole flow control device according to claim 1, wherein the control signal comprises at least one of an acoustic signal and a pressure pulse signal.

12. The downhole flow control device according to claim 1, wherein the control signal is configured to be transmitted from a surface or near surface location.

13. The downhole flow control device according to claim 1, wherein the control signal is configured to be transmitted from a downhole location.

14. The downhole flow control device according to claim 1, configured for use in combination with a sealing arrangement.

15. The downhole flow control device according to claim 14, wherein the sealing arrangement comprises a zonal isolation sealing arrangement.

16. The downhole flow control device according to claim 14, wherein the sealing arrangement comprises at least one of a swelling sealing arrangement, mechanical sealing arrangement and inflatable sealing arrangement.

17. The downhole flow control device according to claim 1, wherein the barrier member is movable and the flow control device is configured to control the barrier member by moving the barrier member.

18. The downhole flow control device according to claim 1, configured for use in injecting a fluid into a downhole formation.

19. The downhole flow control device according to claim 1, configured for use in a fracturing operation, in which the flow control device permits communication of a fracking fluid from within the tubing string to an external location to flow into a surrounding formation.

20. The downhole flow control device according to claim 1, configured for use as an inflow control device.

21. The downhole flow control device according to claim 1, comprising a sensor arrangement configured to sense at least one downhole property, wherein the sensor arrangement is configured for use in assisting determination of a required control of the flow path.

22. The downhole flow control device according to claim 1, wherein the tubing string within which the downhole flow device is configured for use incorporates at least one other flow control device.

23. A method for controlling flow between external and internal locations of a tubing string, comprising:

providing a flow control device according to claim 1;

locating the flow control device at a desired downhole location; and transmitting a control signal to the flow control device to permit control of the barrier member.

24. A completion assembly comprising:

a tubing string; and at least one flow control device according to claim 1.

25. The completion assembly according to claim 24, comprising a plurality of the flow control devices and a zonal isolation sealing arrangement for defining a plurality of annular zones, wherein flow of fluid into and/or out of each zone is individually controllable by one or more of the flow control devices.

26. The completion assembly according to claim 25, wherein the assembly is operable to open the flow control devices associated with at least one zone in order to perform an inflow or outflow operation and then close the flow control devices associated with the at least one zone before opening the flow devices associated with at least one other zone.

* * * * *